US007129013B2

(12) United States Patent
Higuchi et al.

(10) Patent No.: US 7,129,013 B2
(45) **Date of Patent: *Oct. 31, 2006**

(54) TONER AND DEVELOPER FOR DEVELOPING LATENT ELECTROSTATIC IMAGES, AND IMAGE FORMING APPARATUS

(75) Inventors: Hiroto Higuchi, Shizuoka (JP); Masami Tomita, Shizuoka (JP); Fumihiro Sasaki, Shizuoka (JP); Shigeru Emoto, Shizuoka (JP); Naohito Shimota, Shizuoka (JP); Maiko Kondo, Shizuoka (JP); Takahiro Honda, Shizuoka (JP); Junichi Awamura, Shizuoka (JP); Shinichiro Yagi, Shizuoka (JP); Toshiki Nanya, Shizuoka (JP); Tadao Takikawa, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

This patent is subject to a terminal disclaimer.

(21) Appl. No.: 10/760,452

(22) Filed: Jan. 21, 2004

(65) Prior Publication Data

US 2004/0209181 A1 Oct. 21, 2004

(30) Foreign Application Priority Data

Jan. 21, 2003 (JP) ..... 2003-012525

(51) Int. Cl.
*G03G 9/08* (2006.01)

(52) U.S. Cl. ..... 430/108.4; 430/108.8; 430/109.3; 430/109.4; 430/126; 399/262; 399/335

(58) Field of Classification Search ..... 430/108.4, 430/108.8, 109.3, 109.4
See application file for complete search history.

(56) References Cited

U.S. PATENT DOCUMENTS

| | | | | |
|---|---|---|---|---|
| 6,660,443 | B1 | 12/2003 | Sugiyama et al. | |
| 6,667,141 | B1 | 12/2003 | Iwamoto et al. | |
| 6,936,390 | B1 * | 8/2005 | Nanya et al. | 430/108.22 |
| 6,946,229 | B1 * | 9/2005 | Suzuki et al. | 430/109.4 |

FOREIGN PATENT DOCUMENTS

| | | |
|---|---|---|
| EP | 0 421 416 | 4/1991 |
| EP | 1 273 977 | 1/2003 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner for developing latent electrostatic images is in the form of particles prepared by dissolving or dispersing each component of a composition in an organic solvent to form a solution or dispersion, the composition containing at least a resin reactive with a compound having an active hydrogen group, a compound having an active hydrogen group, a coloring agent, a releasing agent, and a graft polymer C of a polyolefin resin A on which a vinyl resin B has been at least partially grafted; dispersing the solution or dispersion in an aqueous medium; reacting the reactive resin with the compound having an active hydrogen group; removing the organic solvent during or after the step of reacting; and washing and drying particles formed by removing the organic solvent.

23 Claims, 10 Drawing Sheets

TONER AND DEVELOPER FOR DEVELOPING LATENT ELECTROSTATIC IMAGES, AND IMAGE FORMING APPARATUS

BACKGROUND OF THE INVENTION

1. Field of the Invention

The present invention relates to a toner for use in a developer for developing latent electrostatic images in, for example, electrophotography, electrostatic recording or electrostatic printing and to an electrophotographic developing system using the toner. More specifically, it relates to a toner for electrophotography, electrophotographic developer and electrophotographic development system, which are used, for example, for copiers, laser printers, facsimiles for plain paper using a direct or indirect electrophotographic developing system. Further, the present invention relates to a toner for electrophotography, an image forming apparatus (development system) and a process cartridge, which are used for full color copiers, full color laser printers, and full color plain paper facsimile machines using a direct or indirect electrophotographic multicolor developing system.

2. Description of the Related Art

In electrophotography, electrostatic recording, and electrostatic printing, a developer is, for example, applied to a latent electrostatic image bearing member such as a photoconductor, so as to dispose the developer onto a latent electrostatic image formed on the latent electrostatic image bearing member in a developing step, the developer disposed on the image is transferred to a recording medium such as a recording paper in a transferring step, thereafter the transferred developer is fixed on the recording medium in a fixing step. Such developers used for developing the latent electrostatic image formed on the latent electrostatic image bearing member generally include two-component developers containing a carrier and a toner, and one-component developers such as magnetic toners and non-magnetic toners, which do not require a carrier. Conventional dry toners for use in electrophotography, electrostatic recording or electrostatic printing are formed by melting and kneading a toner binder (binder resin) such as a styrenic resin or a polyester, a colorant, and other components, then pulverizing the kneaded substance.

These dry toners are, after used for developing and transferred on a recording medium such as a sheet of paper, fixed on the sheet by heating and melting the toner using a heat roller. If a temperature of the heat roller is excessively high, in this procedure, "hot offset" occurs. Hot offset is the problem that the toner is excessively melted and adhered onto the heat roller. If a temperature of the heat roller is excessively low, on the other hand, a degree of melting the toner is insufficient, resulted in insufficient image fixing. Accordingly, there are demands in a toner having a higher temperature at which hot offset occurs (excellent hot offset resistance) and a low fixing temperature (excellent image-fixing properties at low temperatures), in view of energy conservation and miniaturization of apparatuses such as copiers. Toners also require a heat-resistant storability that suppresses blocking of toner when the toner is stored, and at a temperature of atmosphere inside the apparatus where the toner is accommodated. Especially, low melting viscosity of toner is essential in full-color copiers and full-color printers in order to yield high gloss and excellent color mixture of an image. As a consequence, a polyester toner binder which melts sharply has been used in such a toner. However, this toner tends to cause hot offset. To prevent hot offset, in full-color apparatuses, silicone oil has conventionally been applied on the heat roller. Yet, in the method of applying silicone oil to the heat roller, the apparatuses need to equip an oil tank and an oil applier, therefore the apparatuses become more complex in their structures and large in their size. It also leads to a deterioration of the heat roller, so maintenance is required at every certain term. Further, it is unavoidable that the oil is attached to recording media such as copier paper and films for OHP (over head projector), and especially with the films for OHP, the attached oil causes deterioration in color tone.

To prevent a toner fusion without applying oil to a heat roller, wax is generally added to a toner. In this method, however, releasing effect is largely affected by a condition of dispersed wax within a toner binder. Wax does not exhibit its releasing ability if the wax is compatible with a toner binder. Wax exhibits its releasing ability and improves releasing ability of toner when the wax stays within a toner binder as incompatible domain particles. If a diameter of domain particles is excessively large, the resulting toner may not yield images with good quality. This is because a ratio of wax occurring in a surface portion of a toner with respect to other components of the toner increases with an increasing diameter thereof. As a result, the toner particles aggregate to impair fluidity of the toner. Moreover, filming occurs where the wax migrates to a carrier or a photoconductor during long-term use. Color reproducibility and clearness of an image are impaired in the case of color toners. On the contrary, if a diameter of the domain particles is excessively small, the wax is excessively finely dispersed so that sufficient releasing ability cannot be obtained. Although it is necessary to control a diameter of wax as mentioned above, an appropriate method thereof has not been found yet. For example, in the case of toners manufactured by pulverization, control of wax diameter largely relies upon shear force of mixing during melting and kneading procedures. Polyester resins recently used for a toner binder have a low viscosity, and sufficient shear force cannot be added thereto. It is very difficult to control distribution of wax and to obtain a suitable diameter especially for these toners.

Another problem of pulverization is that wax is likely to be exposed at a surface of toner, since a toner material article (for example a toner block) tends to break at a plane where the wax occur as a result of pulverization, and such planes constitute the surface of the toner particles.

Although improvement of toners has been attempted by miniaturizing a diameter of toner particle or narrowing particle diameter distribution of toner in order to obtain high quality images, uniform particle shape cannot be obtained by ordinary manufacturing methods of kneading and pulverization. Moreover, the toner is further pulverized so that excessively fine toner particles are generated, in a course of mixing with carrier in a developing member of the apparatus, or, by a contact stress between a development roller, and a toner applying roller, a layer thickness controlling blade, or a friction charging blade. These lead to deterioration of image quality. In addition, a fluidizer embedded in the surface of toner also leads to deterioration of image quality. Further, fluidity of the toner particles is insufficient because of their shapes, and thus a large amount of the fluidizer is required or a packing fraction of the toner into a toner vessel becomes low. These factors inhibit miniaturization of apparatuses.

A process for transferring, in which an image formed by a multicolor toner is transferred to a recording medium or a sheet of paper, becomes more and more complicated in order to form full-color images. When toners having non-uniform particle shapes, and therefore insufficient transferring ability, such as pulverized toners are used in such a complicated transferring process, missing portions can be found in the transferred image or an amount of the toner consumption becomes large to compensate for the low transferability of the toner.

Accordingly, a strong demand has arisen to yield high quality images which do not have any missing part and to reduce running cost by further improving transfer efficiency leading to a reduction in toner consumption. If transfer efficiency is remarkably excellent, a cleaning unit, which removes remained toner on a photoconductor or a transfer after transferring, can be omitted from an apparatus. Therefore, the apparatus can be miniaturized and low cost thereof can be achieved together with having a merit of reducing a waste toner. Hence, various methods for manufacturing a spherical toner have been suggested in order to overcome the defects caused by a non-uniformly shaped toner.

Various investigations have been done to improve properties of toner. For example, a releasing agent (wax) having a low melting point, such as a polyolefin, is added to a toner in order to improve image-fixing properties at low temperatures and offset resistance. JP-A Nos. 06-295093, 07-84401, and 09-258471 disclose toners that contain a wax having a specific endothermic peak determined by DSC (differential scanning calorimetry). However, the toners disclosed in the above patent publications still need to improve image-fixing properties at low temperatures, offset resistance and also developing properties.

JP-A Nos. 05-341577, 06-123999, 06-230600, and 06-324514 disclose candelilla wax, higher fatty acid wax, higher alcohol wax, vegetable naturally occurring wax (carnauba wax and rice wax), and montan ester wax as a releasing agent of toner. However, the toners disclosed in the above patent publications still need to improve developing properties (charging ability) and durability. If the releasing agent having a low softening point is added to a toner, fluidity of the toner is decreased hence developing properties or transferring ability is also decreased. Moreover, charging ability, durability and storability of the toner may be deteriorated thereby.

JP-A Nos. 11-258934, 11-258935, 04-299357, 04-337737, 06-208244, and 07-281478 disclose toners which contain two or more releasing agents in order to enlarge a fixing region (non offset region). However, the releasing agents are not dispersed sufficiently uniformly in these toners.

JP-A No. 08-166686 discloses a toner which contains polyester resin and two types of offset inhibitors having different acid values and softening points. However, the toner is still insufficient in developing properties. JP-A Nos. 8-328293, and 10-161335 each disclose a toner that specifies a dispersion diameter of wax within the toner particle. However, the resulting toner may not exhibit sufficient releasing ability during fixing since a condition or positioning of the dispersed wax is not defined in the toner particle.

JP-A No. 2001-305782 discloses a toner in which spherical wax particles are fixed onto the surface of toner. However, the wax particles positioned on the surface of toner decreases fluidity of the toner and thus developing properties or transferring ability of the toner is also decreased. In addition, charging ability, durability, and storability of the toner may also be adversely affected. JP-A No. 2001-26541 discloses a toner in which wax is included in the toner particle and the wax is located in a surface portion of the toner particle. However, the toner may be insufficient in all of offset resistance, storability, and durability.

Japanese Patent Application Publications (JP-B) No. 52-3304 and No. 07-82255 disclose that in a pulverized toner using a styrenic resin as a toner binder, a polyolefin releasing agent such as a lower molecular weight polyethylene or lower molecular weight polypropylene, or a graft resin comprising such a polyolefin resin grafted with a styrenic resin. However, the styrene resin used herein has insufficient low-temperature image-fixing properties, and the toner is not suitable for energy saving requirements. As a possible solution to this problem, JP-A No. 2000-75549 proposes a combination use with a polyester resin having excellent low-temperature image-fixing properties. However, the toner proposed is finely pulverized toner prepared by kneading and pulverization, in which the material is fused, kneaded, finely pulverized and classified. The toner thereby has an irregular shape and an irregular surface, and its shape and surface configuration cannot be significantly controlled arbitrarily, while these conditions slightly depend on the crushability of the material or conditions in the pulverization process. In addition, the classification ability at present cannot yield a sharper particle distribution of a toner, and such a sharper particle distribution leads to increased cost. In addition, it is difficult for a conventional pulverized toner to have a small average particle diameter of about 6 μm or less in view of the yield, productivity, and cost of production.

JP-A No. 11-133665 proposes a dry toner containing an elongation product of a urethane-modified polyester and having a practical sphericity of 0.90 to 1.00 as a toner binder in order to improve the fluidity, image-fixing properties at low temperatures, and hot offset resistance of the toner. JP-A No. 11-149180 and JP-A No. 2000-292981 disclose dry toners, and production methods thereof, having a small average particle diameter, which are excellent in fluidity, transfer ability, storage stability at high-temperatures, image-fixing properties at low temperatures, and hot offset resistance. These toners may produce glossy images without requiring application of oil to a heat roller, when used in full color copier. In the publications, these toners are prepared by a method including a process for increasing molecular weight in which a polyester prepolymer having an isocyanate group is subjected to additional polymerization with an amine in an aqueous medium. The technique disclosed in JP-A No. 11-133665 may lead to novel features and advantages by employing a urethane reaction to form a binder in the toner but it is still a pulverization process and does not consider to produce a toner having a small particle diameter and a spherical shape. The toners disclosed in JP-A No. 11-149180 and JP-A No. 2000-292981 are prepared by granulation in water. However, in such granulation in water, a pigment in an oil phase aggregates at the interface with an aqueous phase, and the toner has insufficient fundamental properties such as decreased volume resistivity or heterogenous pigment distribution. To produce a small average particle diameter and a satisfactorily controlled shape of a toner for use in a machine without application of oil, the shape and properties of the toner must be precisely controlled. However, the publications fail to teach the control of the shape and properties of the toner, and intended advantages may not be significantly exhibited. In the toner particles prepared by granulation in water, the pigment and wax often gather in the surface of the particles. In addition, toner particles having an average particle diameter of about 6 μm or less have a large specific surface area. To produce desired charging properties and image-fixing properties, design of the particle surface becomes important in addition to the entire design of the polymer component.

OBJECTS AND ADVANTAGES

Accordingly, an object of the present invention is to provide a toner which has improved low-temperature image-fixing properties and offset resistance for reducing power consumption, can form a high quality toner image and can be stored stably for a long period of time. Another object of the present invention is to provide a high quality toner which is resistant to filming to, for example, a latent electrostatic image bearing member and is free from fogging over a long period of time under mechanical or thermal stresses. Yet another object of the present invention is to provide a toner which can be fixed in a wide range and can produce high quality images. Still another object of the present invention is to provide a toner which has good gloss when used as a color toner and exhibits excellent hot offset resistance. A further object of the present invention is to provide a toner which can produce images with higher resolution and higher precision. Another object of the present invention is to provide a developer which does not invite image deterioration over a long period of time. Yet another object of the present invention is to provide an image forming apparatus and a detachable process cartridge using the toner.

SUMMARY OF THE INVENTION

After intensive investigations to provide a dry toner which can be fixed in a wide range, has excellent powder flowability, transfer ability when it has a small average particle diameter, and exhibits excellent high-temperature storage stability, low-temperature image-fixing properties and hot offset resistance, in particular to provide a dry toner which can produce glossy images when used in a full color copier and does not require the application of oil to a heat roller, the present invention has been accomplished.

Specifically, the present invention provides, in a first aspect, (1) a toner for developing latent electrostatic images, produced by a process comprising the steps of dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted; dispersing the solution or dispersion in an aqueous medium during at least one of elongation and crosslinking reactions of the resin thereby forming a reacted dispersion; removing the organic solvent after or during at least one of the elongation and crosslinking reactions of the resin; and washing and drying particles formed by removing the organic solvent.

In another aspect, the present invention provides (2) a toner for developing latent electrostatic images according to (1), wherein the composition further comprises a coloring agent.

In still another aspect, the present invention provides (3) a toner for developing latent electrostatic images according to (1), wherein the composition further comprises a compound having an active hydrogen group.

In yet another aspect, the present invention provides (4) a toner for developing latent electrostatic images according to (1), wherein the process further comprises the step of adding a compound having an active hydrogen group during the step of dispersing the solution or dispersion in the aqueous medium.

In yet another aspect, the present invention provides (5) a toner for developing latent electrostatic images according to (1), wherein the polyolefin resin A has a softening point of from 80° C. to 140° C.

In another aspect, the present invention provides (6) a toner for developing latent electrostatic images according to (1), wherein the polyolefin resin A comprises at least one monomer unit selected from the group consisting of ethylene, propylene, 1-butene, isobutylene, 1-hexene, 1-dodecene and 1-octadecene toner for developing latent electrostatic images according to (1), wherein the polyolefin resin A has a number average molecular weight of from 500 to 20,000 and a weight average molecular weight of from 800 to 100,000.

In another aspect, the present invention provides (8) a toner for developing latent electrostatic images according to (1), wherein the vinyl resin B has a solubility parameter SP of from 10.0 to 12.6.

In another aspect, the present invention provides (9) a toner for developing latent electrostatic images according to (1), wherein the amount of the graft polymer C is from 10 to 500 parts by weight relative to 100 parts by weight of the releasing agent.

In another aspect, the present invention provides (10) a toner for developing latent electrostatic images according to (1), wherein the vinyl resin B comprises one of: styrene; a combination of styrene and an alkyl ester of acrylic acid; a combination of styrene and an alkyl ester of methacrylic acid; a combination of styrene and acrylonitrile; a combination of styrene and methacrylonitrile; a combination of styrene, an alkyl ester of acrylic acid and acrylonitrile; a combination of styrene, an alkyl ester of acrylic acid and methacrylonitrile; a combination of styrene, an alkyl ester of methacrylic acid and acrylonitrile; and a combination of styrene, an alkyl ester of methacrylic acid and methacrylonitrile.

In another aspect, the present invention provides (11) a toner for developing latent electrostatic images according to (1), wherein the releasing agent comprises at least one selected from the group consisting of a carnauba wax free of nonesterified fatty acid, a rice wax, a montan wax and an ester wax.

In another aspect, the present invention provides (12) a toner for developing latent electrostatic images according to (1), wherein the toner particles have an elliptic shape.

In another aspect, the present invention provides (13) a toner for developing latent electrostatic images according to (1), wherein the toner particles have an elliptic shape having a major axis r1, a minor axis r2 and a thickness r3, wherein the ratio (r2/r1) of the minor axis r2 to the major axis r1 is from 0.5 to 0.8, and the ratio (r3/r2) of the thickness r3 to the minor axis r2 is from 0.7 to 1.0.

In another aspect, the present invention provides (14) a toner for developing latent electrostatic images according to (1), wherein the resin comprises a polyester prepolymer having an isocyanate group, and the compound having an active hydrogen group comprises one of an amine and a derivative thereof.

In another aspect, the present invention provides (15) a toner for developing latent electrostatic images according to (1), wherein the aqueous medium comprises at least one of inorganic dispersing agents and fine polymer particles.

In another aspect, the present invention provides (16) a two-component developer for developing latent electrostatic images, comprising a carrier and a toner, wherein the toner is produced by a process comprising the steps of: dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted; dispersing the solution or dispersion in an aqueous medium during at least one of elongation and crosslinking reactions of the resin thereby forming a reacted dispersion; removing the organic solvent after or during at least one of the elongation and crosslinking reactions of the resin; and washing and drying particles formed by removing the organic solvent.

In another aspect, the present invention provides (17) an image forming apparatus comprising: a photoconductor; a charger for charging the photoconductor; an exposer for exposing the photoconductor to light to form a latent electrostatic image; a developing unit containing a toner and serving for developing the latent electrostatic image using the toner to form a toner image; a transferring unit for transferring the toner image from the photoconductor to a transfer material; and an image fixing unit comprising two rollers for allowing the toner image on the transfer material to pass through between the two rollers to heat and fuse the toner to thereby fix the toner image, wherein the image forming apparatus is so configured as to perform the image fixing at a contact pressure (roller load divided by contact area) between the two rollers of $1.5\times10^5$ Pa or less, and wherein the toner is produced by a process comprising the steps of: dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted; dispersing the solution or dispersion in an aqueous medium during at least one of elongation and crosslinking reactions of the resin thereby forming a reacted dispersion; removing the organic solvent after or during at least one of the elongation and crosslinking reactions of the resin; and washing and drying particles formed by removing the organic solvent.

In another aspect, the present invention provides (18) an image forming apparatus according to (17), wherein the image fixing unit comprises: a heater having a heating element; a film in contact with the heater; and a pressurizing member in intimate contact with the heater with the interposition of the film, wherein the image fixing means is so configured as to allow a recording medium bearing an unfixed toner image to pass through between the film and the pressurizing member to heat and fuse the toner to thereby fix the toner image.

In another aspect, the present invention provides (19) an image forming apparatus according to (17), wherein the photoconductor is an amorphous silicon photoconductor.

In another aspect, the present invention provides (20) an image forming apparatus according to (17), wherein the developing unit has an alternating electric field applying unit for applying an alternating electric field upon development of the latent electrostatic image on the photoconductor.

In another aspect, the present invention provides (21) an image forming apparatus according to (17), wherein the charger comprises a charging member and the charger is so configured as to bring the charging member into contact with the photoconductor and apply a voltage to the charging member to thereby charge the photoconductor.

In another aspect, the present invention provides (22) a process cartridge, integrally comprising: a photoconductor; and at least one means selected from the group consisting of: a charger for charging the photoconductor; a developing unit containing a toner and serving for developing a latent electrostatic image using the toner to form a toner image; and a cleaner for cleaning a residual toner on the photoconductor with a blade after transfer, the process cartridge being detachable from and attachable to a main body of an image forming apparatus, wherein the toner produced by a process comprising the steps of: dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted; dispersing the solution or dispersion in an aqueous medium during at least one of elongation and crosslinking reactions of the resin thereby forming a reacted dispersion; removing the organic solvent after or during at least one of the elongation and crosslinking reactions of the resin; and washing and drying particles formed by removing the organic solvent.

In another aspect, the present invention provides (23) an image forming process, comprising the steps of: charging a photoconductor; exposing the photoconductor to light to form a latent electrostatic image; developing the latent electrostatic image using a toner to form a toner image; transferring the toner image from the photoconductor to a transfer material; and cleaning a residual toner on the photoconductor with a blade after the transferring step, wherein the toner produced by a process comprising the steps of: dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted; dispersing the solution or dispersion in an aqueous medium during at least one of elongation and crosslinking reactions of the resin thereby forming a reacted dispersion; removing the organic solvent after or during at least one of the elongation and crosslinking reactions of the resin; and washing and drying particles formed by removing the organic solvent.

Further objects, features and advantages of the present invention will become apparent from the following description of the preferred embodiments with reference to the attached drawings.

DESCRIPTION OF THE PREFERRED EMBODIMENTS

Figure 1A:
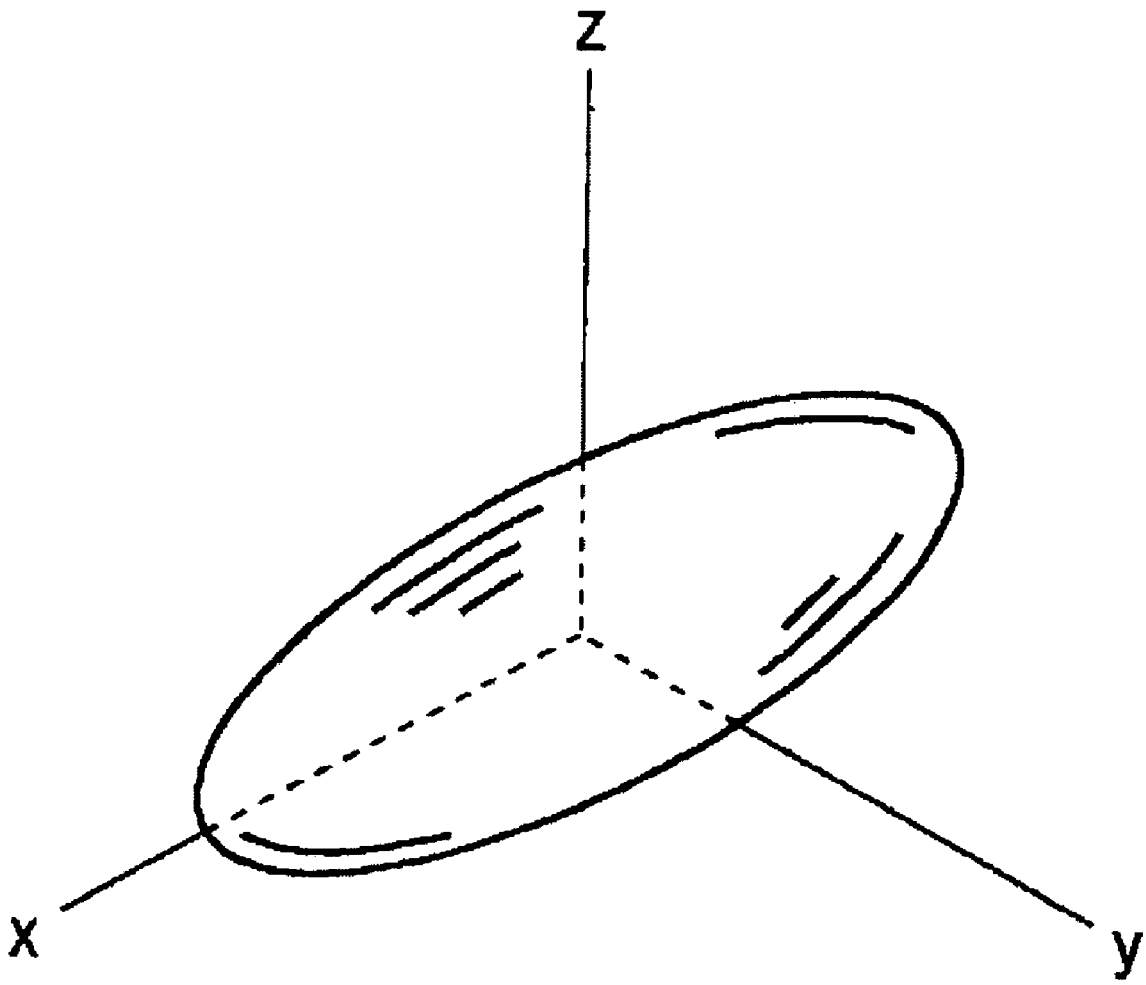
FIGS. 1A, 1B and 1C are a perspective view, a cross sectional view showing a major axis and a thickness, and another cross sectional view showing the minor axis and the thickness, of an elliptic toner.

The present invention will be illustrated in detail below.

Preparation Method

The toner of the present invention can be prepared by a method comprising the steps of dissolving or dispersing each component of a composition in an organic solvent to form a solution or dispersion, the composition comprising at least a resin reactive with a compound having an active hydrogen group, a compound having an active hydrogen group, a coloring agent, a releasing agent, and a graft polymer C of a polyolefin resin A on which a vinyl resin B has been at least partially grafted; dispersing the solution or dispersion in an aqueous medium preferably in the presence of an inorganic dispersing agent or fine polymer particles; subjecting the reactive resin and the compound having an active hydrogen group to addition polymerization; and removing the organic solvent from the resulting emulsion. The toner can also be prepared by a method for producing a dry toner in which a toner composition comprising a polyester resin is dispersed in an aqueous medium to form toner particles, in which a polyester prepolymer having an isocyanate group served as the resin reactive with a compound having an active hydrogen group dispersed in the aqueous medium is subjected to at least one of elongation and crosslinking with an amine or derivative thereof as the compound having an active hydrogen group, and the solvent is removed from the resulting emulsion. More specifically, the toner may be prepared as a result of the reaction between a polyester prepolymer A having an isocyanate group and an amine B. An example of the polyester prepolymer A is a reaction product of a polyester and a polyisocyanate (PIC), in which the polyester is a polycondensate between a polyol (PO) and a polycarboxylic acid (PC) and has an active hydrogen group. The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Examples of the polyol (PO) include diols (DIO) and trihydric or higher polyols (TO). As the polyol (PO), a diol (DIO) alone or a mixture of a diol (DIO) and a small amount of a polyol (TO) is preferred. Examples of the diols (DIO) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred. The trihydric or higher polyols (TO) include, for example, trihydric or higher aliphatic alcohols such as glycerol, trimethylolethane, trimethylolpropane, pentaerythritol, and sorbitol; trihydric or higher phenols such as trisphenol PA, phenol novolacs, and cresol novolacs; and alkylene oxide adducts of these trihydric or higher polyphenols.

The polycarboxylic acid (PC) includes, for example, dicarboxylic acids (DIC) and tri- or higher polycarboxylic acids (TC). As the polycarboxylic acid (PC), a dicarboxylic acid (DIC) alone or in combination with a small amount of a tri- or higher polycarboxylic acid (TC) is preferred. The dicarboxylic acids (DIC) include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms. The tri- or higher polycarboxylic acids (TC) include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid (PC) to react with the polyol (PO).

The ratio of the polyol (PO) to the polycarboxylic acid (PC) in terms of the equivalence ratio [OH]/[COOH] of the hydroxyl groups [OH] to the carboxyl groups [COOH] is generally from 2/1 to 1/1, preferably from 1.5/1 to 1/1, and more preferably from 1.3/1 to 1.02/1.

The polyisocyanate (PIC) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as $\alpha,\alpha,\alpha',\alpha'$-tetramethylxylylene diisocyanate; isocyanurates; blocked products of the polyisocyanates with, for example, phenol derivatives, oximes, or caprolactams; and mixtures of these compounds.

The molar ratio [NCO]/[OH] of isocyanate groups [NCO] to hydroxyl groups [OH] of the hydroxyl-containing polyester is generally from 5/1 to 1/1, preferably from 4/1 to 1.2/1, and more preferably from 2.5/1 to 1.5/1. If the ratio [NCO]/[OH] exceeds 5, the toner may have insufficient image-fixing properties at low temperatures. If the molar ratio of [NCO]/[OH] is less than 1, a urea content of the modified polyester may be excessively low and the toner may have insufficient hot offset resistance. The content of the polyisocyanate (3) in the prepolymer (A) having an isocyanate group is generally from 0.5% to 40% by weight, preferably from 1% to 30% by weight, and more preferably from 2% to 20% by weight. If the content is less than 0.5% by weight, the hot offset resistance may deteriorate, and satisfactory storage stability at high temperatures and image-fixing properties at low temperatures may not be obtained concurrently. If the content exceeds 40% by weight, the image-fixing properties at low temperatures may deteriorate.

The isocyanate-containing prepolymer (A) generally has, in average, 1 or more, preferably 1.5 to 3, and more preferably 1.8 to 2.5 isocyanate groups per molecule. If the amount of the isocyanate group per molecule is less than 1, the resulting urea-modified polyester may have a low molecular weight and the hot offset resistance may deteriorate.

The amine (B) includes, for example, diamines (B1), tri- or higher polyamines (B2), amine alcohols (B3), aminomercaptans (B4), amino acids (B5), and amino-blocked products (B6) of the amines (B1) to (B5). The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine. The tri- or higher polyamines (B2) include, for example, diethylenetriamine, and triethylenetetramine. The amino alcohols (B3) include, but are not limited to, ethanolamine, and hydroxyethylaniline. The aminomercaptans (B4) include, for example, aminoethyl mercaptan, and aminopropyl mercaptan. The amino acids (B5) include, but are not limited to, aminopropionic acid, and aminocaproic acid. The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred are the diamine (B1) alone or in combination with a small amount of the polyamine (B2).

Where necessary, the molecular weight of the modified polyester can be controlled by using an elongation terminator. Such elongation terminators include, but are not limited to, monoamines, such as diethylamine, dibutylamine, butylamine, and laurylamine; and blocked products thereof (ketimine compounds).

The content of the amine (B) in terms of the equivalence ratio [NCO]/[NHx] of isocyanate groups [NCO] in the polyester prepolymer (A) to amino groups [NHx] of the amine (B) is generally from 1/2 to 2/1, preferably from 1.5/1 to 1/1.5 and more preferably from 1.2/1 to 1/1.2. If the ratio [NCO]/[NHx] exceeds 2/1 or is less than 1/2, the polyester may have a low molecular weight, and the hot offset resistance may deteriorate. The urea-modified polyester (UMPE) can be used as the polyester in the present invention, the urea-modified polyester may further have a urethane bond in addition to the urea bond. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot offset resistance may deteriorate.

The urea-modified polyester (UMPE) for use in the present invention can be prepared, for example, by a one shot method or a prepolymer method. The weight average molecular weight of the urea-modified polyester (UMPE) is generally $1\times10^4$ or more, preferably from $2\times10^4$ to $1\times10^7$, and more preferably from $3\times10^4$ to $1\times10^6$. If the weight average molecular weight is less than $1\times10^4$, the hot offset resistance may deteriorate.

In the present invention, the urea-modified polyester (UMPE) can be used alone or in combination with an unmodified polyester (PE) as the binder component of the toner. The combination use of the urea-modified polyester (UMPE) with the unmodified polyester (PE) may improve the image-fixing properties at low temperatures and glossiness upon use in a full-color apparatus and is more preferred than the use of the modified polyester alone. The unmodified polyester (PE) and preferred examples thereof include, for example, polycondensation products of a polyol (PO) and a polycarboxylic acid (PC) as in the polyester component of the urea-modified polyester (UMPE). The unmodified polyesters (PE) include unmodified polyesters as well as polyesters modified with a urethane bond or another chemical bond other than urea bond. The urea-modified polyester (UMPE) and the unmodified polyester (PE) are preferably at least partially compatible or miscible with each other for better image-fixing properties at low temperatures and hot-offset resistance. Accordingly, the urea-modified polyester (UMPE) preferably has a polyester component similar to that of the unmodified polyester (PE). The weight ratio of the urea-modified polyester (UMPE) to the unmodified polyester (PE) is generally from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory storage stability at high temperatures and image fixing properties at low temperatures may not be obtained concurrently.

The hydroxyl value of the unmodified polyester (PE) is preferably 5 or more.

The acid value of the unmodified polyester (PE) is generally from 1 to 30 mg KOH/g, and preferably from 5 to 20 mg KOH/g. The use of a unmodified polyester (PE) having an appropriate acid value allows the toner to be easily negatively charged, to have good affinity for paper upon image fixing and to have improved image-fixing properties at low temperatures. However, if the acid value exceeds 30, the toner may have deteriorated charging stability and may have a varied charge depending on the environment. In addition, a varying acid value may invite insufficient granulation of the addition polymerization product, and the resulting emulsion may not be controlled sufficiently.

Colorant

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The content of the colorant is generally from 1% by weight to 15% by weight, and preferably from 3% by weight to 10% by weight of the toner.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly (methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

Releasing Agent

Various conventional releasing agents can be used in the present invention. Examples of the releasing agents are carnauba wax, montan wax, oxidized rice wax, synthetic ester wax, solid silicone wax, high fatty acid high alcohols, montan ester wax, and low-molecular-weight polypropylene wax. Each of these can be used alone or in combination. Among them, carnauba wax, montan wax, oxidized rice wax and synthetic ester wax are preferred for good low-temperature image-fixing properties and hot offset resistance. The carnauba wax is a naturally occurring wax obtained from Copernicia cerifera, of which one having fine crystals and having an acid value of 5 or less is preferred. Such a carnauba wax can be uniformly dispersed in the binder resin. A carnauba wax which is free from nonesterified fatty acid and has a low acid value is more preferred. The montan wax generally refers to a montan wax purified from minerals, of which one having fine crystals and an acid value of from 5 to 14 is preferred. The oxidized rice wax is a naturally occurring wax prepared by purifying a crude wax obtained in the dewaxing or wintering process of a rice bran oil. The oxidized rice wax preferably has an acid value of from 10 to 30. The synthetic ester wax is prepared synthetically by an ester reaction between a monofunctional linear fatty acid and a monofunctional linear alcohol.

Graft Polymer

The graft polymer C for use in the present invention is of a polyolefin resin A on which a vinyl resin B has been at least partially grafted.

In the toner of the present invention, at least part of the releasing agent is included in the graft polymer C. The term "included" as used herein means that the releasing agent has good compatibility or affinity for the polyolefin resin A moiety of the graft polymer C and is selectively captured by or attached to the polyolefin resin A moiety of the graft polymer C.

A toner may be prepared by a method comprising the steps of dissolving or dispersing each component of a composition in an organic solvent to form a solution or dispersion; dispersing the solution or dispersion in an aqueous medium in the presence of an inorganic dispersing agent or fine polymer particles; subjecting the solution or dispersion to addition polymerization; and removing the organic solvent from the resulting emulsion. Such a toner may also be prepared by a method for producing a dry toner for dispersing a toner composition comprising a polyester resin in an aqueous medium to form toner particles. In these procedures, the binder resin, releasing agent and aqueous medium have insufficient compatibility or miscibility with one another and disperse independently. Accordingly, the releasing agent is not contained in the binder occupying a major part of the toner particles but is exposed at the surface of toner particles as dispersed particles with a large particle diameter. To solve the dispersion failure, a graft polymer C of a polyolefin resin A on which a vinyl resin B has been at least partially grafted is added. The graft polymer C has excellent compatibility with both the releasing agent and the binder resin and thereby enters between the releasing agent and the binder resin to thereby prevent the releasing agent from exposing from the particle surface. In addition, the releasing agent can be dispersed in the vicinity of the particle surface to thereby promptly exhibit its releasing function when the toner passes through an image-fixing device.

Such a graft polymer C being dispersed as particles with a larger particle diameter can enable the releasing agent to be included or attached more easily and to bleed out from the toner surface more easily. However, when the particle diameter of the dispersed graft polymer C is excessively large, the particle diameter of the dispersed releasing agent will tend to increase.

The particle diameter of the dispersed graft polymer C in resin in terms of its major axis is generally from 0.1 μm to 2.5 μm, preferably from 0.3 μm to 2.0 mm, and more preferably from 0.3 μm to 1.5 μm. The resin component preferably comprises substantially no graft polymer C particles having a major axis exceeding 2.5 μm. The content of such graft polymer C particles having an major axis exceeding 2.5 μm in the resin component, if any, is preferably 1% by number or less, and more preferably 0% by number.

Examples of olefins for constituting the polyolefin resin A are ethylene, propylene, 1-butene, isobutylene, 1-hexene, 1-dodecene, and 1-octadecene.

Examples of the polyolefin resin A include olefinic polymers, oxides of olefinic polymers, modified products of olefinic polymers, and copolymers of an olefin with another copolymerizable monomer.

Examples of the olefinic polymers are polyethylenes, polypropylenes, ethylene/propylene copolymers, ethylene/1-butene copolymers, and propylene/1-hexene copolymers.

Examples of the oxides of olefinic polymers are oxides of the aforementioned olefinic polymers.

Examples of the modified products of olefinic polymers are maleic acid derivative adducts of the olefinic polymers. Such maleic acid derivatives include, for example, maleic anhydride, monomethyl maleate, monobutyl maleate, and dimethyl maleate.

Examples of the copolymers of an olefin with another copolymerizable monomer are copolymers of an olefin with a monomer such as unsaturated carboxylic acids (e.g., acrylic acid, methacrylic acid, itaconic acid, and maleic anhydride), alkyl esters of unsaturated carboxylic acids (e.g., $C_1$–$C_{18}$ alkyl esters of acrylic acid, $C_1$–$C_{18}$ alkyl esters of methacrylic acid, and $C_1$–$C_{18}$ alkyl esters of maleic acid).

The polyolefin resin for use in the present invention has only to have a polyolefin structure as a polymer, and its constitutional monomer may not have an olefin structure. For example, a polymethylene such as Sasol wax can be used as the polyolefin resin.

Among these polyolefin resins, preferred are olefinic polymers, oxides of olefinic polymers, and modified products of olefinic polymers, of which polyethylenes, polymethylenes, polypropylenes, ethylene/propylene copolymers, oxidized polyethylenes, oxidized polypropylenes, and maleated polypropylenes are more preferred, and polyethylenes and polypropylenes are typically preferred.

The softening point of the polyolefin resin A is generally from 70° C. to 170° C., and preferably from 80° C. to 140° C. A polyolefin resin A having a softening point of 80° C. or higher leads to good flowability of the toner, and one having a softening point of 140° C. or lower leads to good releasing ability and low-temperature image-fixing properties.

To avoid filming to the carrier and to yield good releasing ability, the polyolefin resin A has a number average molecular weight of generally from 500 to 20,000, preferably from 1,000 to 15,000, and more preferably from 1,500 to 10,000 and a weight average molecular weight of generally from 800 to 100,000, preferably from 1,500 to 60,000, and more preferably from 2,000 to 30,000.

The polyolefin resin A has a penetration of generally 5.0 or less, preferably 3.5 or less, and more preferably 1.0 or less.

As the vinyl resin B, conventional homopolymers and copolymers of vinyl monomers can be used.

Specific examples of the vinyl resin B are homopolymers and copolymers of styrenic monomers, acrylic monomers, methacrylic monomers, vinyl ester monomers, vinyl ether monomers, halogen containing vinyl monomers, diene monomers such as butadiene and isobutylene, acrylonitrile, methacrylonitrile, cyanostyrene, and other unsaturated nitrile monomers, and combinations of these monomers.

The vinyl resin B has a solubility parameter SP of from 10.0 to 12.6 $(cal/cm^3)^{1/2}$, preferably from 10.4 to 12.6 $(cal/cm^3)^{1/2}$, and more preferably from 10.6 to 12.6 $(cal/cm^3)^{1/2}$. When the solubility parameter SP of the vinyl resin B is in a range of from 10.0 to 12.6, the difference in solubility parameter SP between the binder resin and the releasing agent falls within an optimum range and these components can be dispersed satisfactorily. The solubility parameter SP can be determined according to a known Fedors method.

The vinyl resin B may be a homopolymer having a solubility parameter SP of 10.0 to 12.6 $(cal/cm^3)^{1/2}$ and is preferably a copolymer of a vinyl monomer 1 having a solubility parameter SP in terms of a homopolymer of 11.0 to 18.0 $(cal/cm^3)^{1/2}$, more preferably from 11.0 to 16.0 $(cal/cm^3)^{1/2}$ and a monomer 2 having a solubility parameter SP in terms of a homopolymer of from 8.0 to 11.0 $(cal/cm^3)^{1/2}$, and more preferably from 9.0 to 10.8 $(cal/cm^3)^{1/2}$.

The vinyl monomer 1 includes, for example, unsaturated nitrile monomers 1-1, and α,β-unsaturated carboxylic acids 1-2.

Examples of the unsaturated nitrile monomers 1-1 are acrylonitrile, methacrylonitrile and cyanostyrene, of which acrylonitrile and methacrylonitrile are preferred. Examples of the α,β-unsaturated carboxylic acids 1-2 are unsaturated carboxylic acids and anhydrides thereof, such as acrylic acid, methacrylic acid, maleic acid, fumaric acid, itaconic acid, and anhydrides thereof; monoesters of unsaturated dicarboxylic acids, such as monomethyl maleate, monobutyl maleate, and monomethyl itaconate, of which acrylic acid, methacrylic acid and monoesters of unsaturated dicarboxylic acids are preferred, and acrylic acid, methacrylic acid and monoesters of maleic acid such as monomethyl maleate and monobutyl maleate are more preferred.

Examples of the monomer 2 are styrenic monomers such as styrene, α methylstyrene, p methylstyrene, m methylstyrene, p methoxystyrene, p hydroxystyrenes, p acetoxystyrene, vinyltoluenes, ethylstyrenes, phenylstyrenes, and benzylstyrenes; $C_1$–$C_{18}$ alkyl esters of unsaturated carboxylic acids, such as methyl acrylate, methyl methacrylate, ethyl acrylate, ethyl methacrylate, butyl acrylate, butyl methacrylate, 2-ethylhexyl acrylate and 2-ethylhexyl methacrylate; vinyl ester monomers such as vinyl acetate; vinyl ether monomers such as vinyl methyl ether; halogen containing vinyl monomers such as vinyl chloride; diene monomers such as butadiene and isobutylene; and combinations of these monomers. Among them, preferred are a styrenic monomer alone, an alkyl ester of unsaturated carboxylic acid, and combinations of these monomers, of which styrene alone or a combination of styrene and an alkyl ester of acrylic acid or methacrylic acid.

The vinyl resin B has a number average molecular weight of generally form 1,500 to 100,000, preferably from 2,500 to 50,000, and more preferably from 2,800 to 20,000, and a weight average molecular weight of generally form 5,000 to 200,000, preferably from 6,000 to 100,000, and more preferably from 7,000 to 50,000.

The vinyl resin B has a glass transition point Tg of generally from 40° C. to 90° C., preferably from 45° C. to 80° C., and more preferably from 50° C. to 70° C. for better storage stability (when Tg≧40° C.) and better low-temperature image-fixing properties (when Tg≦90° C.).

Specific examples of the graft polymer C are those comprising the following polyolefin resins A and the vinyl resins B.

Oxidized polypropylene A grafted with a styrene/acrylonitrile copolymer B

Polyethylene and polypropylene mixture A grafted with a styrene/acrylonitrile copolymer B Ethylene/propylene copolymer A grafted with a styrene/acrylic acid/butyl acrylate copolymer B Polypropylene A grafted with a styrene/acrylonitrile/butyl acrylate/monobutyl maleate copolymer B Maleic acid-modified polypropylene A grafted with a styrene/acrylonitrile/acrylic acid/butyl acrylate copolymer B Maleic acid-modified polypropylene A grafted with a styrene/acrylonitrile/acrylic acid/2-ethylhexyl acrylate copolymer B Mixture A of polyethylene and maleic acid-modified polypropylene grafted with an acrylonitrile/butyl acrylate/styrene/monobutyl maleate copolymer B The graft polymer C can be prepared, for example, in the following manner. Initially, a wax such as a polyolefin resin is dissolved or dispersed in a solvent such as toluene or xylene, is heated to 100° C. to 200° C., and is subjected to graft polymerization with a vinyl monomer added dropwise with a peroxide polymerization initiator such as benzoyl peroxide, di-tert-butyl peroxide or tert-butyl peroxide benzoate, and the solvent is distilled off to yield the graft polymer C.

The amount of the peroxide polymerization initiator in the graft polymerization is generally form 0.2% by weight to 10% by weight, and preferably from 0.5% by weight to 5% by weight based on the weight of the reactants.

The resulting graft polymer C may include an unreacted polyolefin resin A or a vinyl resin B formed as a result of the reaction between the vinyl monomers. According to the present invention, it is not necessary to remove these polyolefin resin A and the vinyl resin B from the graft polymer C, and such a graft polymer C may be suitably used as a resin mixture containing these components.

To constitute the graft polymer C, the amount of the polyolefin resin A is generally from 1% by weight to 90% by weight and preferably from 5% by weight to 80% by weight, and the amount of the vinyl resin B is generally form 10% by weight to 99% by weight and preferably from 20% by weight to 95% by weight, based on the total weight of the graft polymer C.

The content of the graft polymer C (including unreacted polyolefin resin A and vinyl resin B) in the toner is preferably 10 to 500 parts by weight relative to 100 parts by weight of the releasing agent, for better releasing ability and better dispersion of the releasing agent to prevent filming. Of the releasing agent in the toner, preferably 80% by weight or more, and more preferably 90% by weight or more is included in the graft polymer C.

Charge Control Agent

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. Its amount is preferably from 0.1 to 10 parts by weight, and more preferably from 0.2 to 5 parts by weight relative to 100 parts by weight of the binder resin. If the amount exceeds 10 parts by weight, the toner may have an excessively high charge, the charge control agent may not sufficiently play its role, the developer may have increased electrostatic attraction to a development roller, may have decreased fluidity or may induce a decreased density of images. These charge control agent and releasing agent may be fused and kneaded with a master batch and a resin component or may be added to the other materials when they are dissolved and dispersed in an organic solvent.

External Additive

Inorganic fine particles can be preferably used as the external additive to improve or enhance the flowability, developing properties, and charging ability of the toner particles. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2.0% by weight of the toner. Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these flowability-imparting agents to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

Toner Preparation in Aqueous Medium

Aqueous media for use in the present invention may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone.

To form toner particles, a dispersion containing the isocyanate-containing prepolymer (A) is allowed to react with the amine or derivative thereof, in an aqueous medium. To stably form the dispersion containing the prepolymer (A), for example, a toner material composition comprising the urea-modified polyester (UMPE) or the prepolymer (A) is dispersed in an aqueous medium by action of shear force. The other toner components (hereinafter referred to as "toner materials") such as the coloring agent, coloring agent master batch, releasing agent, charge control agent, and unmodified polyester resin may be mixed with the prepolymer (A) during a dispersing procedure in the aqueous medium for the formation of a dispersion. However, it is preferred that these toner materials are mixed with one another beforehand and the resulting mixture is added to the aqueous medium. The other toner materials such as the coloring agent, the mold release agent, and the charge control agent is not necessarily added during the formation of the particles in the aqueous medium and can be added to the formed particles. For example, particles containing no coloring agent are formed, and the coloring agent is then added to the formed particles according to a known dying procedure.

The dispersing procedure is not specifically limited and includes known procedures such as low-speed shearing, high-speed shearing, dispersing by friction, high-pressure jetting, and ultrasonic dispersion. To allow the dispersion to have an average particle diameter of from 2 to 20 μm, the high-speed shearing procedure is preferred. When a high-speed shearing dispersing machine is used, the number of rotation is not specifically limited and is generally from 1,000 to 30,000 rpm and preferably from 5,000 to 20,000 rpm. The dispersion time is not specifically limited and is generally from 0.1 to 5 minutes in a batch system. The dispersion is performed at a temperature of generally 20° C. or lower for 30 to 60 minutes for preventing aggregation of the pigment.

The amount of the aqueous medium is generally from 50 to 2,000 parts by weight, and preferably from 100 to 1,000 parts by weight relative to 100 parts by weight of the toner composition containing the urea-modified polyester (UMPE) or the prepolymer (A). If the amount is less than 50 parts by weight, the toner composition may not be dispersed sufficiently to thereby fail to yield toner particles having a set average particle diameter. If it exceeds 2,000 parts by weight, it is not economical. The oil phase in this procedure must have a viscosity of 2,000 mP.s as determined with a type B viscometer. If the viscosity of the oil phase is less than 2,000 mP.s, the pigment particles become more movable in the dispersed oil phase and thereby aggregate. Thus, the toner may have the pigment particles insufficiently dispersed and may have a decreased volume resistivity value. The system should be kept at 15° C. or lower even after the dispersion of the pigment to avoid the aggregation of the pigment particles.

Where necessary, a dispersing agent can be used. Such a dispersing agent is preferably used for sharper particle distribution and more stable dispersion.

Fine Polymer Particles

The fine polymer particles for use in the present invention preferably has a glass transition point Tg of from 50° C. to 70° $C_4$ and a weight average molecular weight of from $10\times10$ to $30\times10^4$.

The resin constituting the fine polymer particles can be any known resin, as long as it can form an aqueous dispersion, and can be either a thermoplastic resin or a thermosetting resin. Examples of such resins are vinyl resins, polyurethane resins, epoxy resins, polyester resins, polyamide resins, polyimide resins, silicone resins, phenolic resins, melamine resins, urea resins, aniline resins, ionomer resins, and polycarbonate resins. Each of these resins can be used alone or in combination. Among them, vinyl resins, polyurethane resins, epoxy resins, polyester resins, and mixtures of these resins are preferred for easily preparing an aqueous dispersion of fine spherical polymer particles.

Examples of the vinyl resins are homopolymers or copolymers of vinyl monomers, such as styrene-acrylic ester resins, styrene-methacrylic ester resins, styrene-butadiene copolymers, acrylic acid-acrylic ester copolymers, methacrylic acid-acrylic ester copolymers, styrene-acrylonitrile copolymers, styrene-maleic anhydride copolymers, styrene-acrylic acid copolymers and styrene-methacrylic acid copolymers.

In order to remove the organic solvent from the obtained emulsified dispersion, the whole part thereof can be gradually heated so as to completely evaporate the organic solvent. The sphericity (circularity) of the toner particles can be controlled by adjusting the magnitude of stirring of the emulsion before the removal of the organic solvent and the time period for removing the organic solvent. By slowly removing the solvent, the toner particles have a substantially spherical shape with a sphericity of 0.980 or more. By vigorously stirring the emulsion and removing the solvent in a short time, the toner particles have a rough or irregular shape with a sphericity of about 0.900 to 0.960. More specifically, the sphericity can be controlled within a range of from 0.850 to 0.990 by removing the solvent from the emulsion after the emulsification and the reaction while stirring the emulsion with a high stirring power at a temperature of 30° C. to 50° C. in a stirring chamber. By rapidly removing the organic solvent such as ethyl acetate during granulation, formed particles may undergo volume shrinkage to thereby have a certain shape with a certain sphericity. However, the solvent should be removed within 1 hour. If it takes 1 hour or more, the pigment particles may aggregate to thereby decrease the volume resistivity.

Alternatively, it can be removed by spraying the emulsion into a dry atmosphere, thereby completely removing the non-water-soluble organic solvent in the sprayed droplets to thereby form fine toner particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln.

In addition, a solvent that can dissolve the urea-modified polyester (UMPE) and/or the prepolymer (A) can be used for a lower viscosity of the dispersion (toner composition). The solvent is preferably volatile and has a boiling point of lower than 100° C. for easier removal. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic hydrocarbon solvents, methylene chloride, 1,2-dichloroethane, chloroform, carbon tetrachloride, and other halogenated hydrocarbons. The amount of the solvent is generally from 0 to 300 parts by weight, preferably from 0 to 100 parts by weight, and more preferably from 25 to 70 parts by weight, relative to 100 parts by weight of the prepolymer (A). The solvent, if any, is removed by heating at atmospheric pressure or under reduced pressure after the elongation and/or crosslinking reaction.

The reaction time for elongation and/or crosslinking between the reactive modified polyester (RMPE) and the amine (B) as a crosslinking agent and/or elongation agent is appropriately set depending on the reactivity based on the combination of the isocyanate structure of the prepolymer (A) and the amine (B) and is generally from 10 minutes to 40 hours and preferably from 2 to 24 hours. The reaction temperature is generally from 0° C. to 150° C. and preferably from 40° C. to 98° C. Where necessary, a known catalyst such as dibutyltin laurate and dioctyltin laurate can be used.

The organic solvent can be removed from the prepared emulsion, for example, by gradually elevating the temperate of the entire system and completely removing the organic solvent in the primary particles by evaporation. Alternatively, it can be removed by spraying the emulsion into a dry atmosphere, thereby completely removing the non-water-soluble organic solvent in the primary particles to thereby form fine toner particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln.

When the particle distribution of the primary particles is wide and the adjustment of the particle distribution is not carried out in the washing and drying processes, the particles in the emulsion may be classified.

The particles can be classified by removing fine particle fractions using a cyclone, decanter or centrifugal separator in a liquid. Although the classification can be carried out on dried particles after drying, it is more preferred that the classification be carried out in a solution, from the viewpoint of efficiency of the process. The obtained irregular toner particles and coarse particles, as a result of the classification, are sent back to the kneading step so as to recycle. In this case, the fine particles or coarse particles may be in a wet condition.

The dispersing agent is preferably removed from the obtained dispersion, and more preferably removed at the same time of the classification.

The dried toner powder particles may be mixed with finely-divided particles of various agents such as a releasing agent, a charge control agent, a flowability-imparting agent, and a coloring agent. By the application of mechanical impact to the mixture of particles, the finely-divided particles of various agents can be fixedly deposited on the surface of the toner particles or uniformly blended with the toner particles on the surface thereof. Thus, the particles of various agents attached to the surface of the toner particles can be prevented from falling off.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefor include angmill (available from Hosokawa Micron Corporation), a modified I-type mill (available from Nippon Pneumatic MFG., Co., Ltd.) whose pulverizing air pressure is reduced, a hybridization system (available from Nara Machine Corporation), Kryptron System (available from Kawasaki Heavy Industries, Ltd.), and an automatic mortar.

Carrier for Two component Developer

The present invention provides a two component developer comprising a carrier and the toner. Any known carrier can be used herein, such as iron powder, ferrite powder, nickel powder and other magnetic powders, as well as glass beads, and resin coated products of these particles or powders.

Resin powders for coating the carrier include, for example, powders of styrene acrylic copolymers, silicone resins, maleic acid resins, fluorocarbon resins, polyester resins, and epoxy resins. The styrene acrylic copolymers preferably contain 30% by weight to 90% by weight of styrene component. If the styrene content is less than 30% by weight, the developer may have insufficient developing properties. If it exceeds 90% by weight, the coating film becomes excessively hard and thus is susceptible to flaking off to thereby shorten the life of the carrier.

The resin coating of the carrier may further comprise other additives such as adhesion imparting agents, curing agents, lubricants, conducting agents, and charge control agents, in addition to the resin.

A more preferred embodiment of the toner will be described below. Specifically, the toner of the present invention preferably has an elliptic shape.

When the shape of a toner is irregular or compressed and the toner has poor particle fluidity because of its shape, following problems occur. The toner deposits on the background of images, as a result of insufficient friction charge. It is difficult for such badly shaped toner to precisely and uniformly be placed on very fine latent dot images at developing step. Therefore, such toner generally has poor dot reproducibility. Further, the toner has insufficient transfer efficiency in latent electrostatic transferring system since the irregularly shaped toner is hard to receive electric lines of force.

Toner particles being substantially spherical have an excessively high fluidity, excessively respond to external force and thereby readily scatter outside of dots during development and transfer procedures. In addition, spherical toner particles easily roll into the space between a photoconductor and a cleaning member, thus inviting cleaning failure.

The toner having an elliptic shape has an appropriately controlled fluidity, can be charged by friction smoothly and thereby avoids toner deposition on the background of images. The toner image can be precisely developed in exact accordance with fine latent dot images and can be efficiently transferred to, for example, a recording medium, thus exhibiting excellent dot reproducibility. The appropriate fluidity of the toner can also prevent scattering of the toner particles during these procedures. In addition, the elliptic toner is more resistant to cleaning failures than a spherical toner, since the axis with which the elliptic toner can roll is limited and therefore it is less likely to slip under a cleaning member.

Figure 1B:
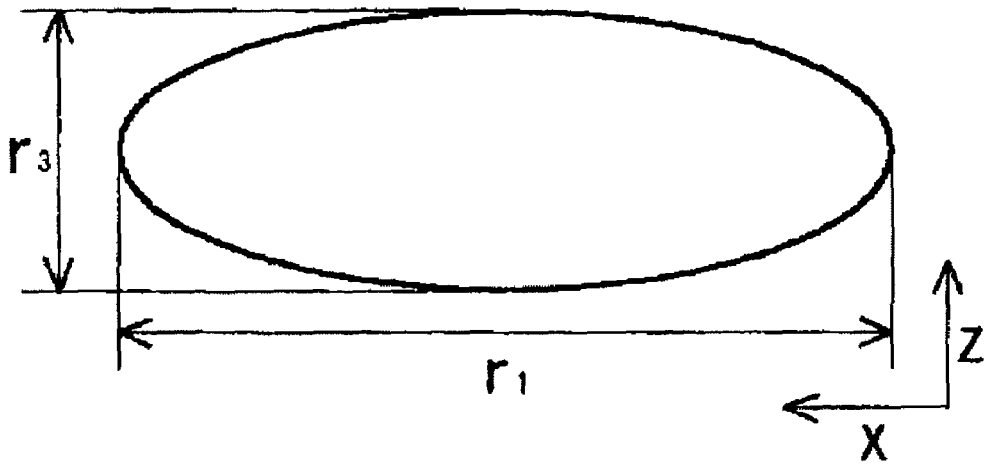
Figure 1C:
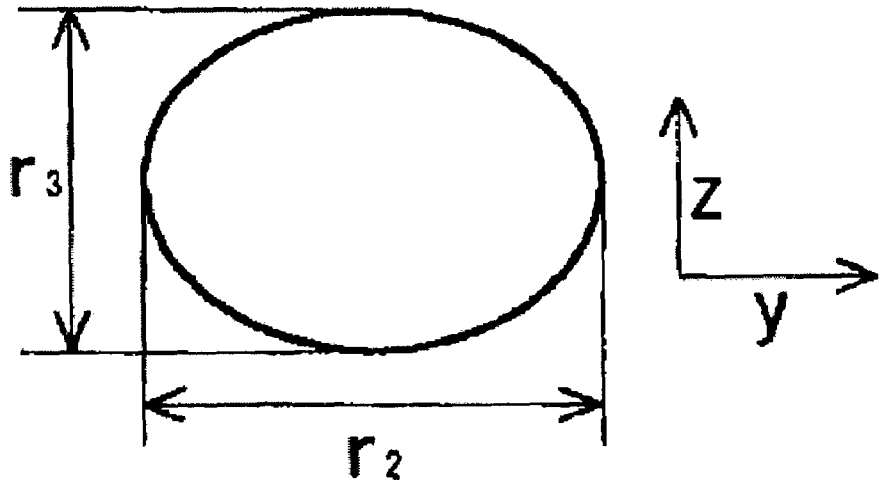

The elliptic toner particles are preferably in an elliptic shape having a major axis r1, a minor axis r2, and a thickness r3, in which the ratio (r2/r1) of the minor axis r2 to the major axis r1 is from about 0.5 to about 0.8, and the ratio (r3/r2)

of the thickness r3 to the minor axis r2 is from about 0.7 to about 1.0, as schematically illustrated in FIGS. 1A, 1B and 1C.

If the ratio (r2/r1) is less than about 0.5, a cleaning property of the toner is high because of less spherical toner particle shape. However, it is insufficient in dot reproducibility and transfer efficiency hence high quality images may not be obtained.

If the ratio (r2/r1) exceeds about 0.8, the toner particle shape is close to sphere and cleaning failures may occur specially in an atmosphere of low temperatures and low humidity since. If the ratio (r3/r2) is less than 0.7, the toner is flat and cannot be efficiently transferred as a spherical toner, although it does not scatter as in a toner having an irregular shape. Especially when the ratio (r3/r2) is 1.0, the shape of the toner becomes almost like a rotator having the main axis as its rotating axis. By satisfying this numeric requirement, the toner has a particle shape other than an irregular shape, flat shape, and sphere. This is the shape that can attain all of friction charging ability, dot reproducibility, transfer efficiency, scattering inhibition, and cleaning ability.

FIGS. 1A, 1B and 1C show the relation among the major axis, minor axis and thickness of the toner particle. The lengths showing with r1, r2 and r3 can be monitored and measured with a scanning electron microscope (SEM) by taking pictures from different angles.

The image forming apparatus of the present invention uses the toner of the present invention and is so configured as to perform the image fixing at a contact pressure (roller load divided by contact area) between the two rollers of $1.5\times10^5$ Pa or less.

Figure 2:
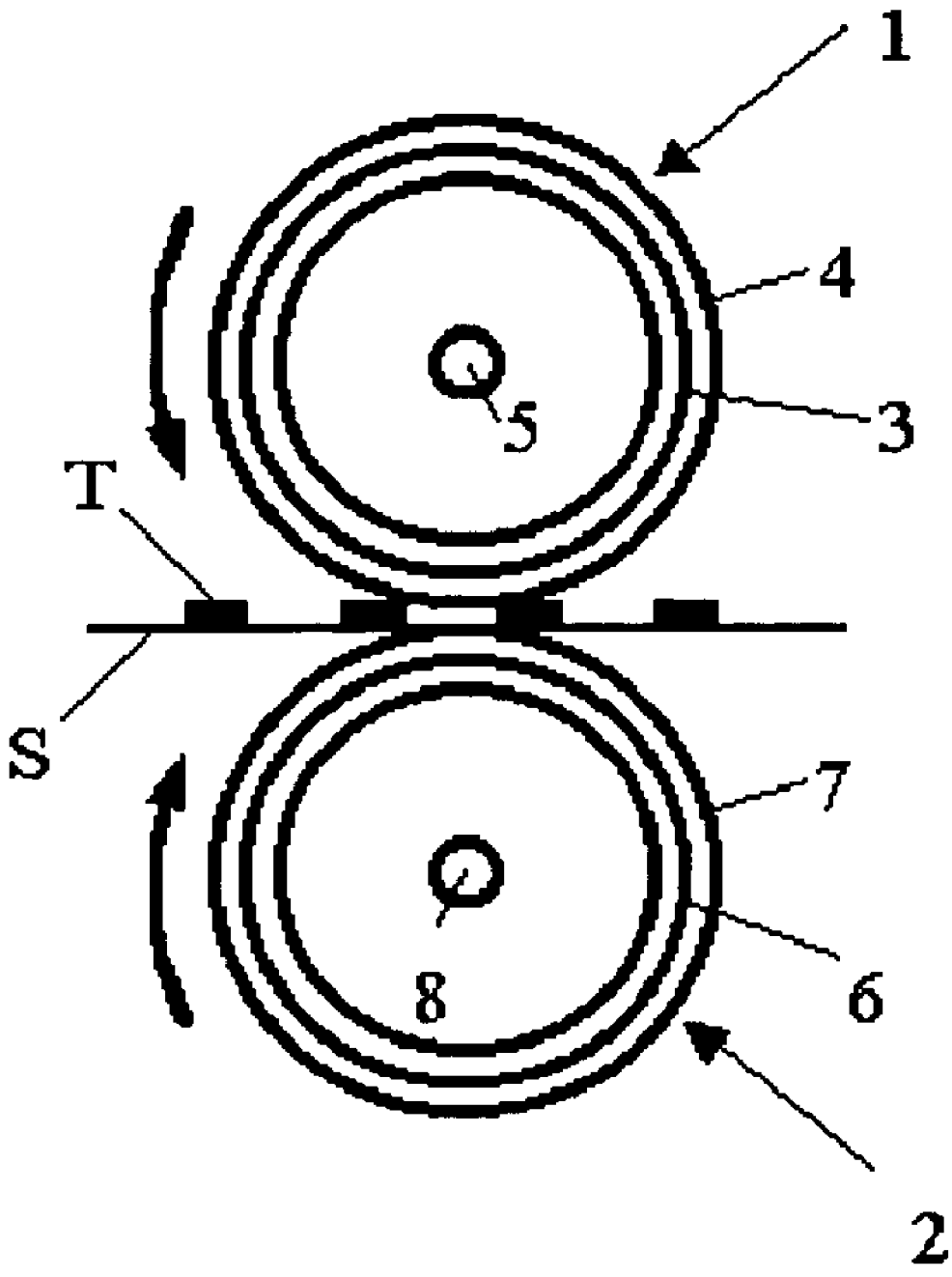
FIG. 2 is a schematic diagram of a fixing device in an image forming apparatus of an example of the present invention.

FIG. 2 is a schematic diagram of a fixing device in the image forming apparatus of an example of the present invention. FIG. 2 shows a fixing roller 1, a pressurizing roller 2, a metal cylinder 3, an offset preventing layer 4, a heating lamp 5, another metal cylinder 6, another offset preventing layer 7, another heating lamp 8, a toner image T, and a substrate (support) S such as a transfer sheet of paper.

In a conventional fixing device for use in such an image forming apparatus, the contact pressure (roller load/contact area) between two rollers exceeds $1.5\times10^5$ Pa. If not, the image cannot be sufficiently fixed. In contrast, the toner of the present invention can be fixed even at low temperatures and also at a low contact pressure of $1.5\times10^5$ Pa or less. By fixing at a low contact pressure, the toner image on the transfer medium is not deformed and thereby yields image output with high precision.

The image forming apparatus of the present invention uses the toner of the present invention and may contain image fixing means (fixing device) which comprises a heater having a heating element; a film in contact with the heater; and a pressurizing member in intimate contact with the heater with the interposition of the film, and the image fixing means is so configured as to allow a recording medium bearing an unfixed toner image to pass through between the film and the pressurizing member to heat and fuse the toner to thereby fix the toner image.

Figure 3:
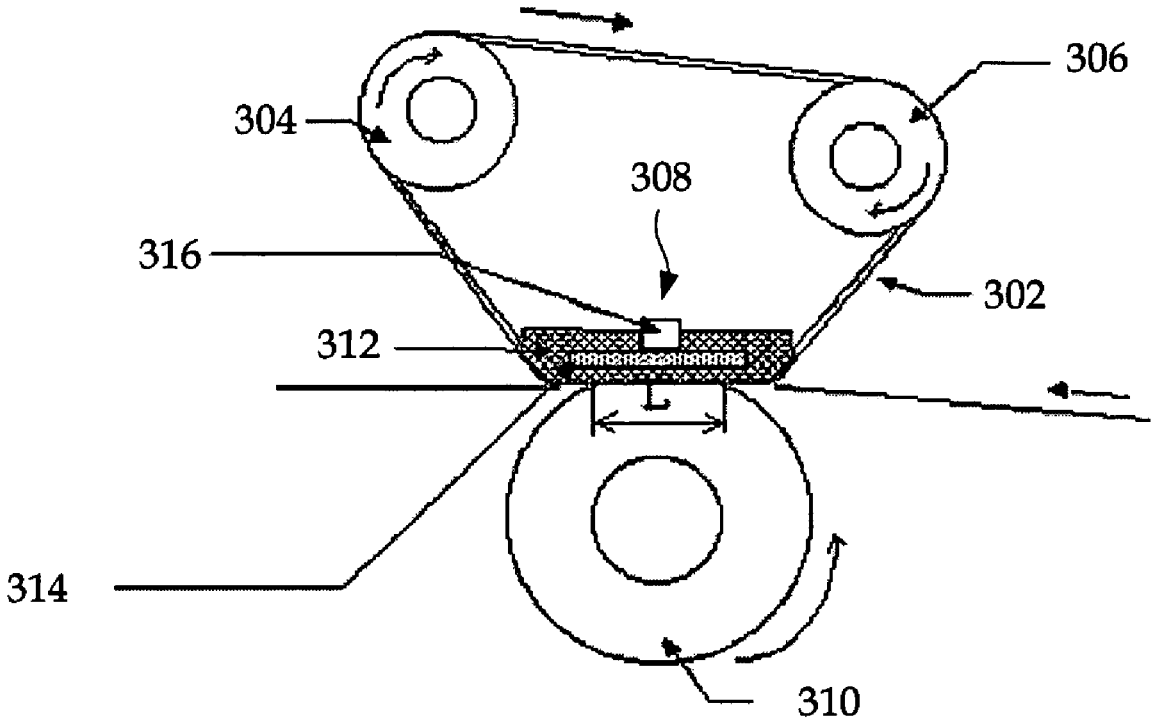
FIG. 3 is a schematic diagram of a fixing device according to an example of the present invention.

With reference to FIG. 3, the fixing device is a SURF (surface rapid fusing) fixing device in which fixing is carried out by rotating a fixing film 302. Specifically, the fixing film 302 is a heat resistant film in a form of an endless belt, and the fixing film 302 is spanned around a driving roller 304 which is a supportive rotator of the fixing film 302, a driven roller 306, and a heating member 308 which is disposed downside and between the driving roller 304 and driven roller 306.

The driven roller 306 also works as a tension roller of the fixing film 302. The fixing film 302 is driven and thereby rotates in a clockwise rotating direction as shown in the figure by the driving roller 304. The rotating speed is controlled so that the fixing film 302 travels at the same speed as a transfer medium in a nip region L in which a pressurizing roller 310 and the fixing film 302 come in contact with each other.

The pressurizing roller 310 has a rubber elastic layer having an excellent releasing ability, such as silicone rubber. The pressurizing roller 310 rotates in a counterclockwise direction so as to adjust a total contact pressure at 4 kg to 10 kg with respect to the fixing nip region L.

The fixing film 302 preferably has excellent heat resistance, releasing ability and wearing resistance. The thickness thereof is generally 100 μm or less, and preferably 40 μm or less. Examples of the fixing film are a single layered film of heat resistant resins such as polyimide, poly(ether imide), PES (poly(ether sulfide)), and PFA (tetrafluoroethylene perfluoroalkyl vinyl ether copolymer), and a multilayered film which comprises a film having a thickness of 20 μm and a releasing coat layer of 10 μm thickness, formed of electroconducting agent added fluoride resin such as PTFE (polytetrafluoroethylene resin) and PFA, or an elastic layer such as fluorocarbon rubber or silicone rubber disposed on the side in contact with an image.

In FIG. 3, the heating member 308 according to the present embodiment contains a flat substrate 312 and a fixing heater 314. The flat substrate 312 is formed of a material having high thermal conductivity and high electric resistance, such as alumina. On the surface of the heating member 308 where the fixing film 302 is in contact with, the fixing heater 314 formed of a resistant heating element is disposed so that the longer side of the fixing heater 314 lies along the traveling direction of the fixing film 302. Such fixing heater is, for example, screen printed with electric resistant material such as Ag/Pd or $Ta_2N$ in linear stripe or band stripe. Moreover, two electrodes (not shown) are disposed at both ends of fixing heater 314 so that the resistant heating element generates a heat by energizing between the electrodes. Further, on a side of the flat substrate 312 opposite to the fixing heater 314, a fixing thermal sensor 316 formed of a thermistor is disposed.

Thermal information of the flat substrate 312 is detected by the fixing thermal sensor 316 and is sent to a controller so that quantity of electricity applied to the fixing heater is controlled and thus the heating member is controlled at a predetermined temperature.

The process cartridge of the present invention uses the toner of the present invention, integrally has a photoconductor and at least one unit selected from charging unit, developing unit, and cleaning unit and is detachable from and attachable to a main body of an image forming apparatus.

Figure 4:
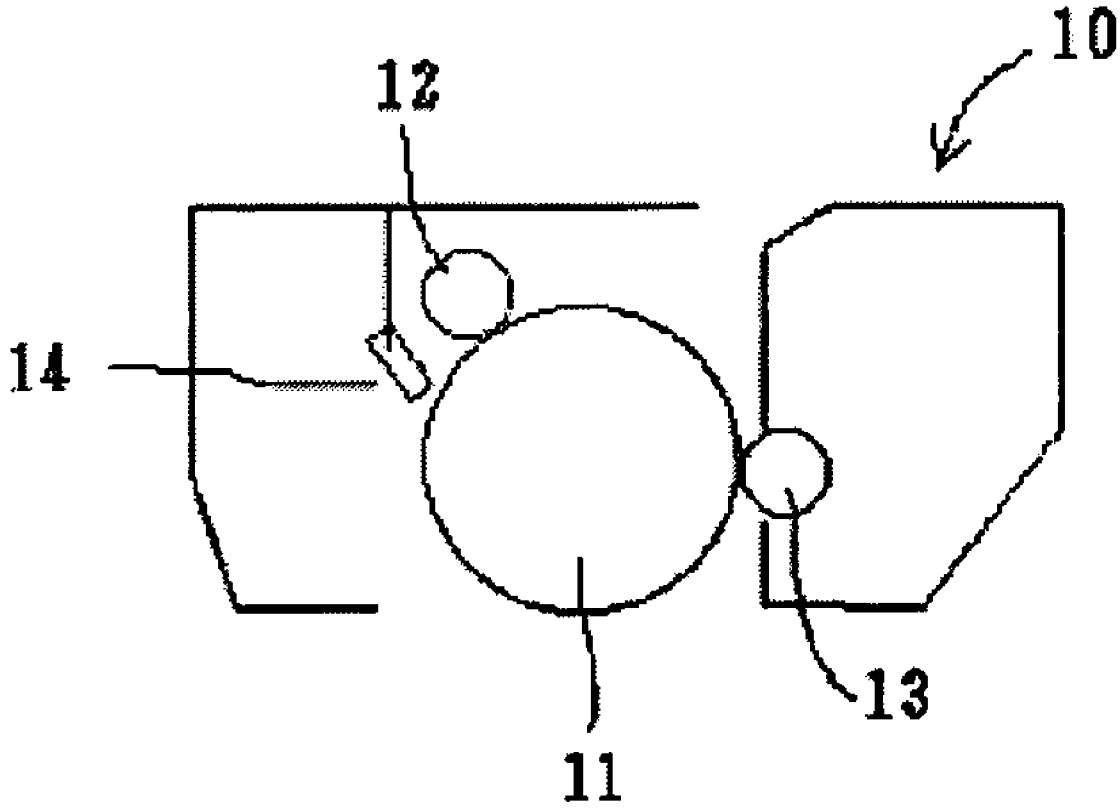
FIG. 4 is a schematic diagram of an image forming apparatus having a process cartridge of an example of the present invention.

FIG. 4 is a schematic diagram of an image forming apparatus having the process cartridge of the present invention.

The process cartridge 10 of FIG. 4 includes a photoconductor 11, a charger 12, a developing device 13, and a cleaner 14.

According to the present invention, the photoconductor 11 and at least one of the charger 12, developing device 13, and cleaner 14 are integrally incorporated to form a process cartridge which is configured as being detachable from and attachable to a main body of an image forming apparatus such as a copier or printer.

In the image forming apparatus which equips the process cartridge of the present invention, the photoconductor is rotated at a predetermined peripheral speed. During the cycle of a rotation of the photoconductor, the charger (charging means) uniformly charges the photoconductor at predetermined positive or negative potential, thereafter a light irradiator such as slit exposure or laser beam scanning exposure, irradiates light imagewise to the charged photoconductor. In this way, latent electrostatic images are sequentially formed on the circumference surface of the photoconductor. As follow, the image developer develops the formed latent electrostatic image with the toner so as to form a toner image, and then the transfer unit sequentially transfers the toner image onto a transfer medium which is fed from a paper feeder to between the photoconductor and the transfer unit at the same timing to the rotation of the photoconductor. The transfer medium bearing the transferred toner image is separated from the photoconductor, and is introduced to a fixer. The fixer fixes the transferred image onto the transfer medium so as to form a reproduction (copy) and then the copy is sent out from the apparatus, i.e., printed out. After transferring the toner image, a cleaner removes the remained toner onto the surface of the photoconductor so as to clean the surface. The charge of the photoconductor is then eliminated for another image formation.

The photoconductor for use in the image forming apparatus is preferably an amorphous silicon photoconductor.

Amorphous Silicon Photoconductor

In the present invention, an amorphous silicon photoconductor is used as a photoconductor for electrophotography. The amorphous silicon photoconductor (hereinafter referred to as a-Si photoconductor) has a conductive substrate and a photoconductive layer formed of a-Si. The photoconductive layer is formed on the substrate, while heating it to a temperature of from 50° C. to 400° C., by a film forming method such as vacuum deposition, sputtering, ion-plating, thermal CVD, optical CVD, plasma CVD, or the like. Of these, preferable method is plasma CVD in which raw material gas is decomposed by glow discharge of direct current, high frequency or microwave, and then a-Si is deposited on the substrate so as to form an a-Si film.

Layer Structure

Figure 5A:
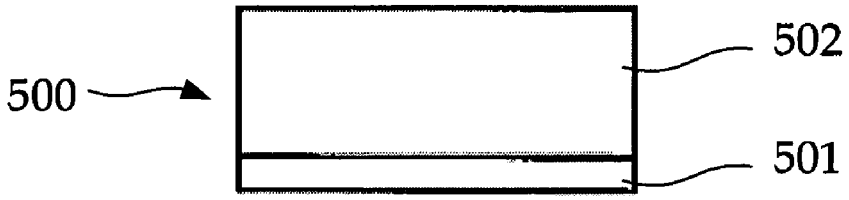
FIGS. 5A, 5B, 5C, and 5D are each a schematic diagram of an example of the layer configuration of a photoconductor for use in an example of the present invention.
Figure 5B:
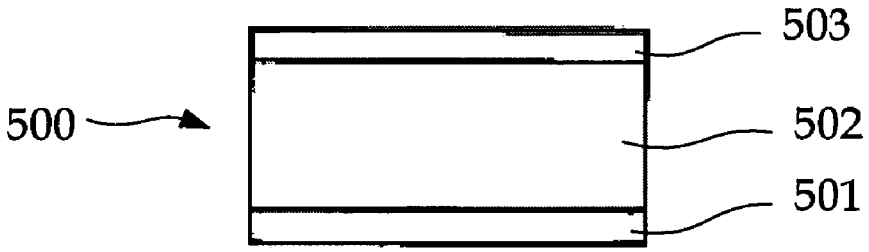
Figure 5C:
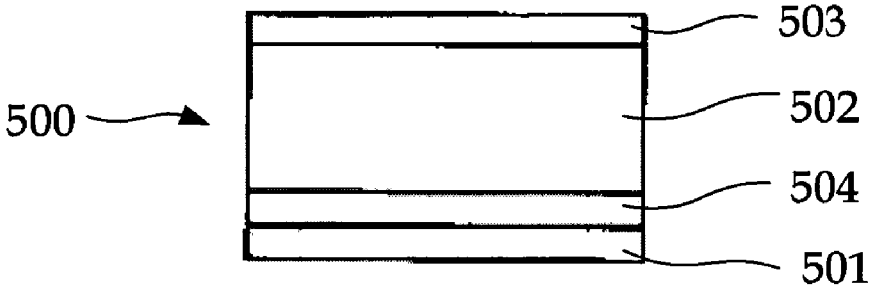
Figure 5D:
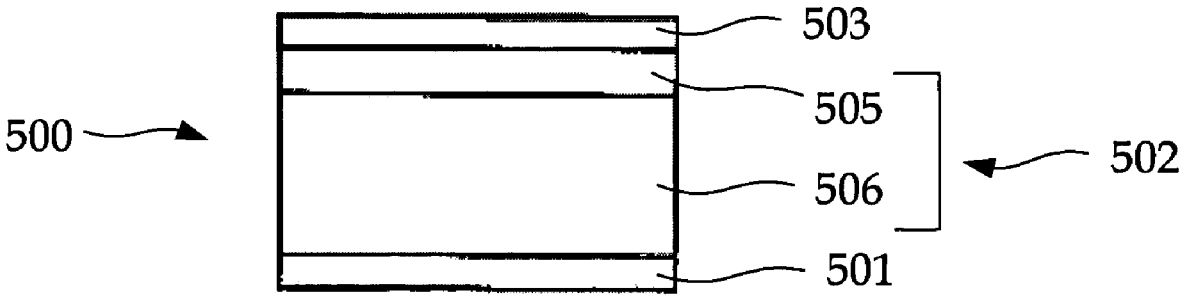

Examples of the layer structure of the amorphous silicon photoconductor are as follows. FIGS. 5A, 5B, 5C and 5D are schematic diagrams which explain the layer structure of the amorphous silicon photoconductor. With reference to FIG. 5A, a photoconductor for electrophotography 500 has a substrate 501 and a photoconductive layer 502 on the substrate 501. The photoconductive layer 502 is formed of a-Si: H, X, and exhibits photoconductivity. With reference to FIG. 5B, a photoconductor for electrophotography 500 has a substrate 501, on which a photoconductive layer 502 formed of a-Si: H, X and an amorphous silicon surface layer 503 are arranged. With reference to FIG. 5C, a photoconductor for electrophotography 500 has a substrate 501, and on the substrate 501, a photoconductive layer 502 formed of a-Si: H, X, an amorphous silicon surface layer 503 and an amorphous silicon charge injection inhibiting layer 504. With reference to FIG. 5D, a photoconductor for electrophotography 500 has a substrate 501 and a photoconductive layer 502 on the substrate 501. The photoconductive layer 502 comprises a charge generation layer formed of a-Si: H, X 505 and a charge transport layer 506. The photoconductor for electrophotography 500 further has an amorphous silicon surface layer 503 on the photoconductive layer 502.

Substrate

The substrate of the photoconductor may be electrically conductive or insulative. Examples of the conductive substrate include metals such as Al, Cr, Mo, Au, In, Nb, Te, V, Ti, Pt, Pd, and Fe, and alloys thereof such as stainless steel. An insulative substrate in which at least a surface facing to a photoconductive layer is treated to yield conductivity can also be used as the substrate. Examples of such insulative substrates are a film or sheet of a synthetic resin such as a polyester, polyethylene, polycarbonate, cellulose acetate, polypropylene, polyvinyl chloride, polystyrene or polyamide, glass, or ceramic.

The shape of the substrate may be cylindrical, plate, or endless belt, which has a smooth or irregular surface. The thickness thereof can be adjusted so as to form a predetermined photoconductor. In the case that flexibility is required to the photoconductor, the substrate can be as thin as possible within ranges efficiently functioning as a substrate. The thickness of the substrate is generally 10 μm or more from the viewpoints of, for example, manufacture, handling, and mechanical strength.

Charge Injection Inhibiting Layer

In the photoconductor used in the present invention, it is effective to dispose a charge injection inhibiting layer between the conductive substrate and the photoconductive layer (FIG. 5C). The charge injection inhibiting layer inhibits a charge injection from the conductive substrate. The charge injection inhibiting layer has a polarity dependency. Namely, when charges of a specific polarity are applied to a free surface of the photoconductor, the charge injection inhibiting layer functions so as to inhibit a current injection from the conductive substrate to the photoconductive layer, and when charges of the opposite polarity are applied, the charge injection inhibiting layer does not function. In order to attain such function, the charge injection inhibiting layer contains relatively larger amounts of atoms which control conductivity, compared with the photoconductive layer.

The thickness of the charge injection inhibiting layer is preferably about 0.1 μm to about 5 μm, more preferably 0.3 μm to 4 μm, and furthermore preferable 0.5 μm to 3 μm for desired electrophotographic properties and better economical efficiency.

Photoconductive Layer

The photoconductive layer may be disposed above the substrate 501 according to necessity. The thickness of the photoconductive layer is not particularly limited, as long as desired electrophotographic properties and high cost efficiency are obtained. The thickness is preferably about 1 μm to about 100 μm, more preferably 20 μm to 50 μm, and furthermore preferably 23 μm to 45 μm.

Charge Transport Layer

When the photoconductive layer is divided by its functions into plural layers, the charge transport layer mainly functions to transport currents. The charge transport layer comprises at least silicon atoms, carbon atoms, and fluorine atoms as its essential components. If needed, the charge transport layer may further comprise hydrogen atoms and oxygen atoms so that the charge transport layer is formed of a-SiC(H,F,O). Such charge transport layer exhibits desirable photoconductivity, especially charge holding property, charge generating property, and charge transporting property. It is particularly preferable that the charge transport layer contains an oxygen atom.

The thickness of the charge transport layer is suitably adjusted so as to yield desirable electrophotographic property and cost efficiency. The thickness thereof is preferably about 5 μm to about 50 μm, more preferably 10 μm to 40 μm, and the most preferably 20 μm to 30 μm.

Charge Generation Layer

When the photoconductive layers is divided by its functions into plural layers, the charge generation layer mainly functions to generate charges. The charge generation layer contains at least silicon atoms as an essential component and does not substantially contain a carbon atom. If needed, the charge generation layer may further comprise hydrogen atoms so that the charge generation layer is formed of a-Si:H. Such charge generation layer exhibits desirable photoconductivity, especially charge generating property and charge transporting property.

The thickness of the charge generation layer is suitably adjusted so as to yield desirable electrophotographic property and cost efficiency. The thickness thereof is preferably about 0.5 μm to about 15 μm, more preferably 1 μm to 10 μm, and the most preferably 1 μm to 5 μm.

Surface Layer

The amorphous silicon photoconductor for use in the present invention may further contain a surface layer disposed on the photoconductive layer formed as mentioned above on the substrate. The surface layer is preferably an amorphous silicon layer. The surface layer has a free surface so that desirable properties such as moisture resistance, usability in continuous repeated use, electric strength, stability in operating environment, and durability.

The thickness of the surface layer is generally about 0.01 μm to about 3 μm, preferably 0.05 μm to 2 μm, and more preferably 0.1 μm to 1 μm. If the thickness is less than about 0.01 μm, the surface layer is worn out during usage of the photoconductor. If it exceeds about 3 μm, electrophotographic properties are impaired such as an increase of residual charge.

The image forming apparatus of the present invention is preferably so configured as to apply an alternating field when a latent electrostatic image on the photoconductor is developed.

Figure 6:
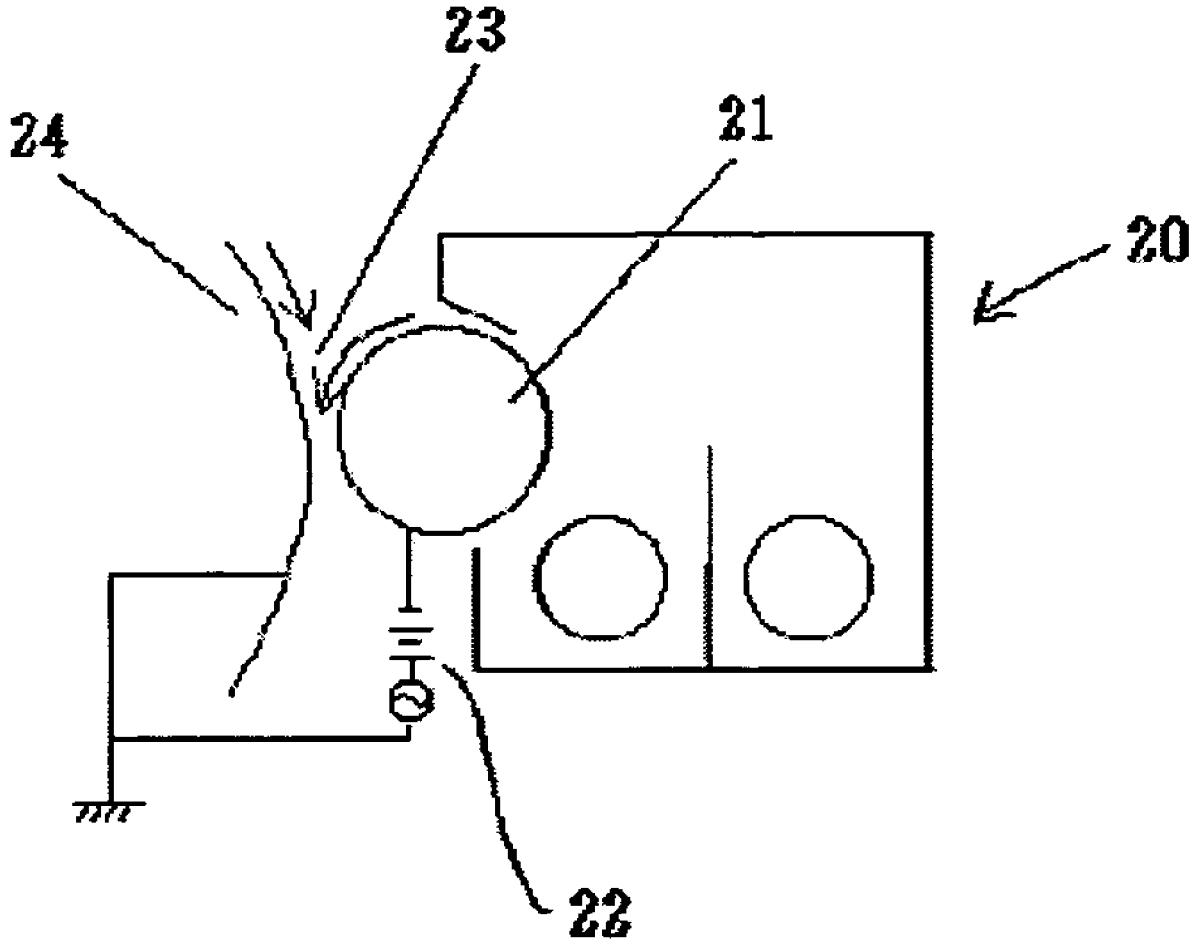
FIG. 6 is a schematic diagram of a developing device for use in an example of the present invention.
Figure 7:
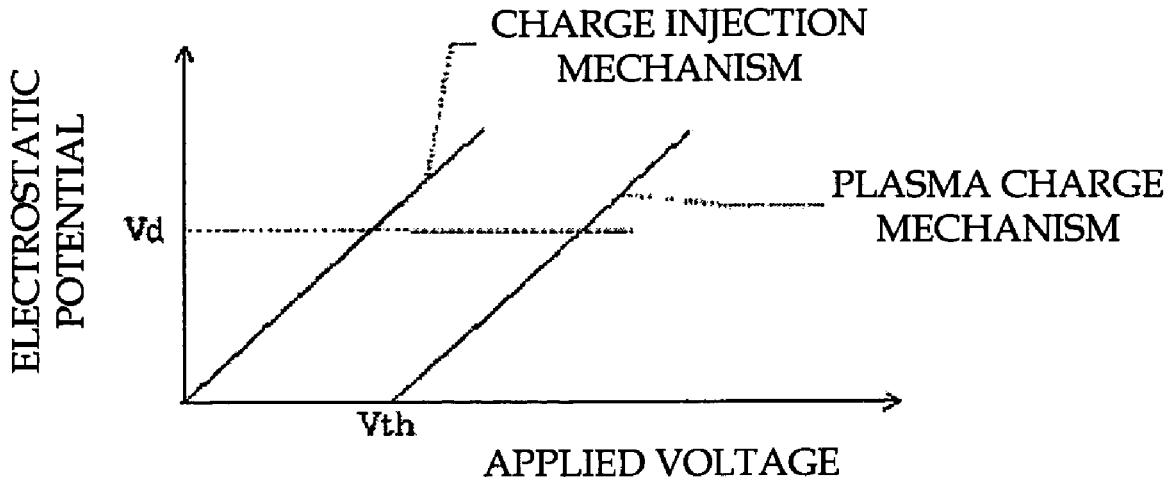
FIG. 7 is a graph showing the charging properties in contact charging.

In a developing device 20 according to the present embodiment shown in FIG. 6, a power supply 22 applies a vibrating bias voltage as developing bias, in which a direct current voltage and an alternating voltage are superimposed, to a developing sleeve 21 during developing. The potential of background part and the potential of image part are positioned between the maximum and the minimum of the vibration bias potential. This forms an alternating field, whose direction alternately changes, at developing region 23. A toner and a carrier in the developer are intensively vibrated in this alternating field, so that the toner overshoots the electrostatic force of constraint from the developing sleeve 21 and the carrier, and leaps to the photoconductor drum 24. The toner is then attached to the photoconductor 24 in accordance with a latent electrostatic image thereon.

The difference between the maximum and the minimum of the vibration bias voltage (peak to peak voltage) is preferably 0.5 kV to 5 kV, and the frequency is preferably 1 kHz to 10 kHz. The waveform of the vibration bias voltage may be a rectangular wave, a sine wave, or a triangular wave. The direct current voltage of the vibration bias voltage is in a range between the potential at the background and the potential at the image as mentioned above, and is preferably set closer to the potential at the background from viewpoints of inhibiting a toner deposition on the background.

When the vibration bias voltage is a rectangular wave, it is preferred that a duty ratio is 50% or less. Duty ratio is a ratio of time when the toner leaps to the photoconductor during a cycle of the vibration bias. In this way, the difference between the peak value when the toner leaps to the photoconductor and the time average value of bias can become very large. Consequently, the movement of the toner becomes further activated, and the toner is accurately attached to the potential distribution of the latent electrostatic image. Accordingly, rough depositition is reduced and image resolution can be improved. Moreover, the difference between the peak value when the oppositely charged carrier leaps to the photoconductor and the time average value of bias can be decreased. Consequently, the movement of the carrier can be restrained and the possibility of the carrier deposition on the background is largely reduced.

The charger (electrostatic charger) for use in the image forming apparatus of the present invention is preferably a contact charger. Such a charger contains an electrostatic charging member, and the electrostatic charging member is brought in contact with the photoconductor as a latent electrostatic image bearing member and applies voltage so as to charge the photoconductor.

Roller Charger

Figure 8A:
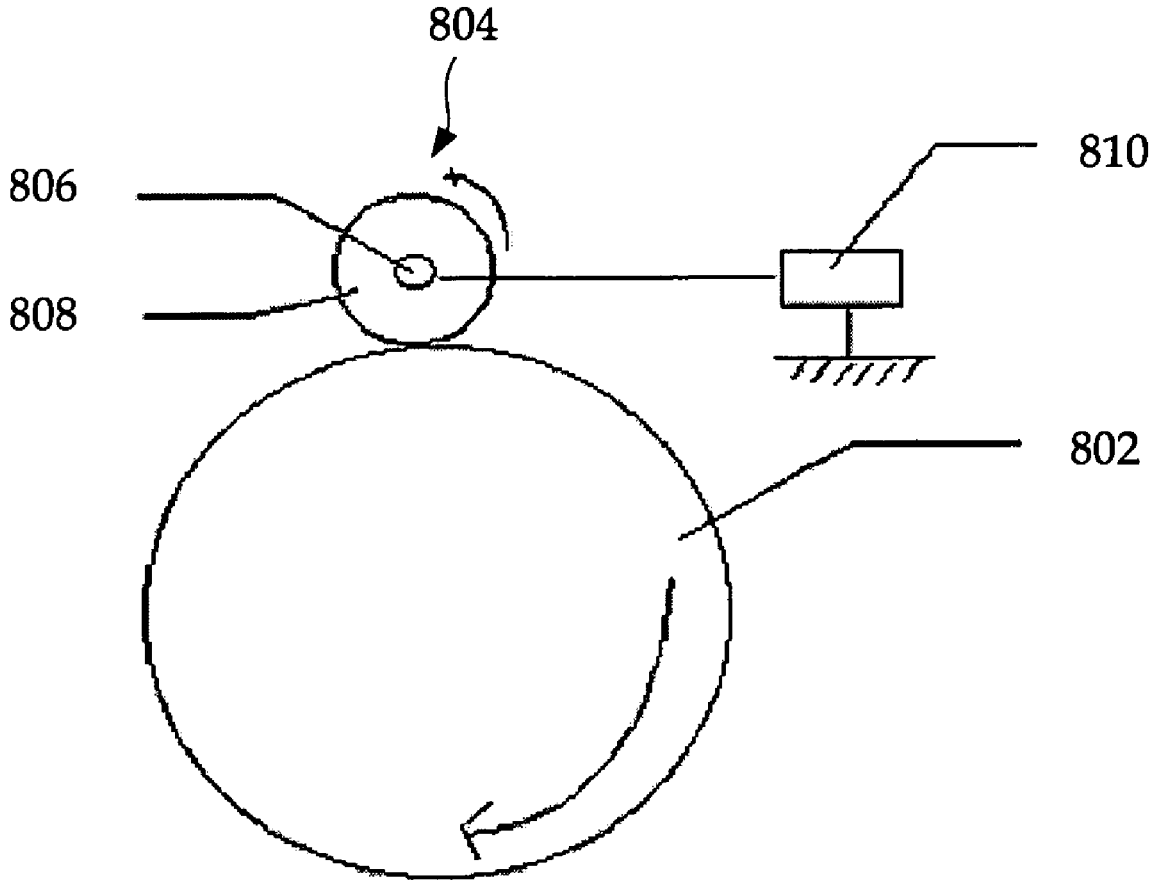
FIGS. 8A and 8B are schematic diagrams of a roller contact charger and a brush contact charger, respectively.

FIG. 8A is a schematic diagram of an example of the image-forming apparatus that is equipped with a contact charger. The photoconductor 802 to be charged as an image bearing member is rotated at a predetermined speed (process speed) in the direction shown with the arrow in the figure. The charging roller 804, which is brought into contact with the photoconductor 802, contains a core rod 806 and a conductive rubber layer 808 formed on the core rod 806 in a shape of a concentric circle. The both terminals of the core rod 806 are supported with bearings (not shown) so that the charging roller 804 enables to rotate freely, and the charging roller 804 is pressed to the photoconductor 802 at a predetermined pressure by a pressurizing member (not shown). The charging roller 804 in this figure therefore rotates along with the rotation of the photoconductor. The charging roller 804 is generally formed with a diameter of 16 mm in which a core rod having a diameter of 9 mm is coated with a rubber layer having a moderate resistance of approximately 100,000 Ω·cm.

The power supply 810 shown in the figure is electrically connected with the core rod, and a predetermined bias is applied to the core rod by the power supply. Thus, the surface of the photoconductor is uniformly charged at a predetermined polarity and potential.

As a charger for use in the present invention, the shape thereof is not specifically limited and can for example be, apart from a roller, a magnetic brush or a fur brush. It can be suitably selected according to a specification or configuration of an image-forming apparatus. When a magnetic brush is used as a charger, the magnetic brush contains an electrostatic charger formed of various ferrite particles such as Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that is made conductive by treatment with, for example, carbon, copper sulfide, a metal or a metal oxide, and the fur is coiled or mounted to a metal or another core rod which is treated conductive.

Fur Brush Charger

Figure 8B:
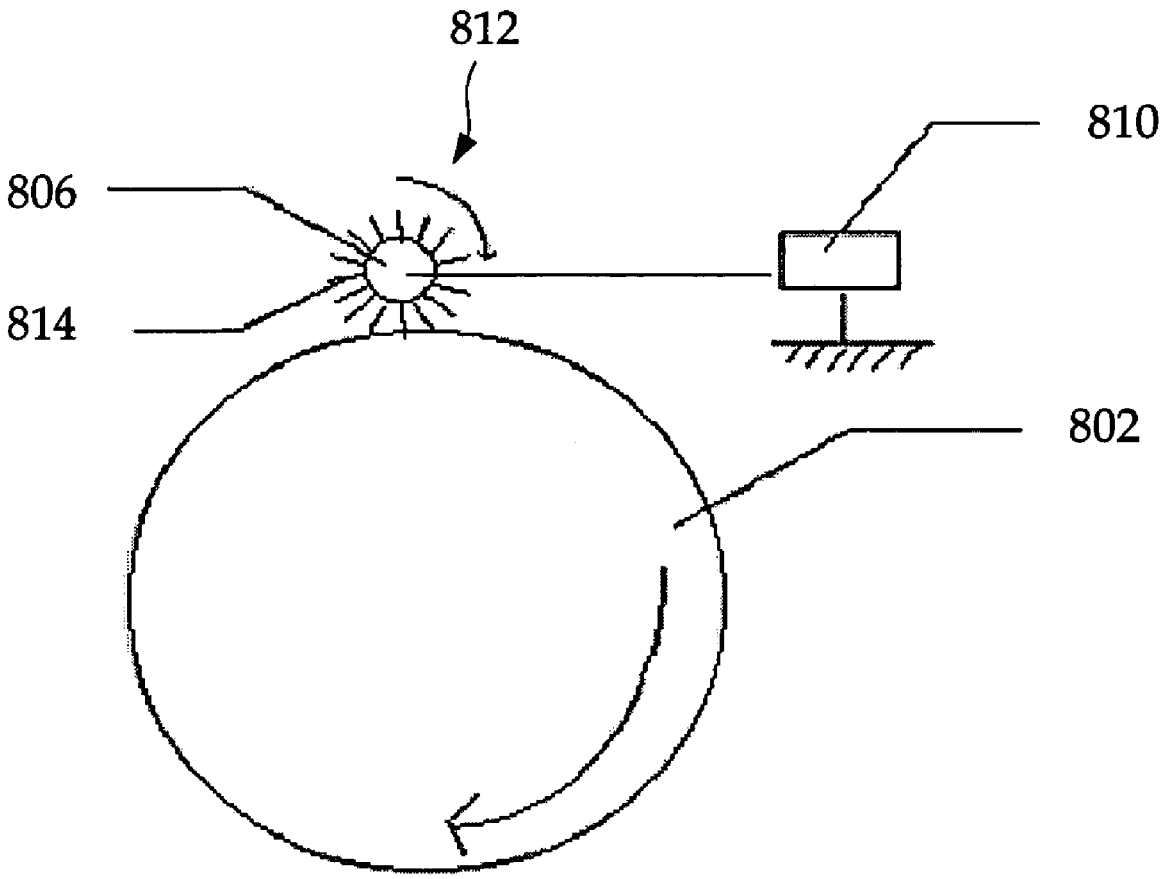

FIG. 8B is a schematic diagram of another example of the image-forming apparatus that is equipped with a contact charger. The photoconductor 802 as an object to be charged and image bearing member, is rotated at a predetermined speed (process speed) in the direction shown with the arrow in the figure. The brush roller 812 having a fur brush is brought in contact with the photoconductor 802, with a predetermined nip width and a predetermined pressure with respect to elasticity of the brush part 814.

The fur brush roller 812 as the contact charger used in the present invention has an outside diameter of 14 mm and a longitudinal length of 250 mm. In this fur brush, a tape with a pile of conductive rayon fiber REC-B (trade name, available from Unitika Ltd.), as a brush part 814, is spirally coiled around a metal core rod 806 having a diameter of 6 mm, which is also functioned as an electrode. The brush of the brush part 814 is of 300 denier/50 filament, and a density of 155 fibers per 1 square millimeter. This brush roller is once inserted into a pipe having an internal diameter of 12 mm while rotating in one direction, and is set so as to share the same axis with the pipe. Thereafter, the brush roller in the pipe is left in an atmosphere of high humidity and high temperature so as to twist the fibers of the fur.

The resistance of the fur brush roller is $1\times10^5\Omega$ at an applied voltage of 100 V. This resistance is calculated from the current obtained when the fur brush roller is contacted with a metal drum having a diameter of 30 mm with a nip width of 3 mm, and a voltage of 100 V is applied thereon.

The resistance of the fur brush roller should be $10^4\Omega$ or more in order to prevent image imperfection caused by an insufficient charge at the charging nip part when the photoconductor to be charged happens to have low electric strength defects such as pin holes thereon and an excessive leak current therefore runs into the defects. Moreover, it should be $10^7\Omega$ or less in order to sufficiently charge the surface of the photoconductor.

Examples of the material of the fur include, in addition to REC-B (trade name, available from Unitika Ltd.), REC-C, REC-M1, REC-M10 (trade names, available from Unitika Ltd.), SA-7 (trade name, available from Toray Industries, Inc.), Thunderon (trade name, available from Nihon Sanmo Dyeing Co., Ltd.), Beltron (trade name, available from Kanebo Gohsen, Ltd.), Kuracarbo in which carbon is dispersed in rayon (trade name, available from Kuraray Co., Ltd.), and Roval (trade name, available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 to 10 mm.

The fur brush roller is rotated in the opposite (counter) direction to the rotation direction of the photoconductor at a predetermined peripheral velocity, and comes into contact with the photoconductor with a velocity deference. The power supply applies a predetermined charging voltage to the fur brush roller so that the surface of the photoconductor is uniformly charged at a predetermined polarity and potential. In contact charge of the photoconductor by the fur brush roller of the present embodiment, charges are mainly directly injected and the surface of the photoconductor is charged at the substantially equal voltage to the applying charging voltage to the fur brush roller.

The electrostatic charger for use in the present invention is not specifically limited in its shape and can be, for example, a charging roller or magnetic fur blush, as well as a fur blush roller. The shape can be selected according to the specification and configuration of the image forming apparatus. When a charging roller is used, it generally comprises a core rod and a rubber layer of moderate resistance of about 100,000 Ω·cm coated on the core rod. When a magnetic fur blush is used, it generally comprises, for example, particles of ferrite such as Zn—Cu ferrite as an electrostatic charging member, a non magnetic conductive sleeve supporting the ferrite particles, and a magnet roll included in the conductive sleeve.

Magnetic Brush Charger

FIG. 8B is a schematic diagram of one example of the image-forming apparatus that is equipped with a contact charger. This figure can be used to illustrate an embodiment using a magnetic brush charger as well. The photoconductor 802 as an object to be charged and image bearing member is rotated at a predetermined speed (process speed) in the direction shown with the arrow in the figure. The brush roller 812 having a magnetic brush is brought in contact with the photoconductor 802, with a predetermined nip width and a predetermined pressure with respect to elasticity of the brush part 814.

The magnetic brush 812 as a contact charger of the present embodiment is formed of magnetic particles. In the magnetic particles, Zn—Cu ferrite particles having an average particle diameter of 25 μm and Zn—Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charger of this embodiment formed from the above-mentioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip 5 mm wide with the photoconductor. The gap between the non-magnetic conductive sleeve and the photoconductor is adjusted to approximately 500 μm. The magnetic roller is rotated so as to subject the non-magnetic conductive sleeve to rotate so that its surface is at twice in speed relative to the peripheral speed of the surface of the photoconductor, and in the opposite direction with the photoconductor. Therefore, the magnetic brush is uniformly in contact with the photoconductor.

As a charger for use in the present invention, the shape thereof is not specifically limited and can for example be, apart from a magnetic brush, a charging roller or a fur brush. It can be suitably selected according to a specification or configuration of an image forming apparatus. When a charging roller is used, it generally comprises a core rod and a rubber layer of moderate resistance of about 100,000 Ω·cm coated on the core rod. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

The present invention will be illustrated in further detail with reference to several examples and comparative examples below, which are never intended to limit the scope of the present invention. All of the words "part" or "parts" as used below are by weight unless otherwise indicated. Toners used in the following examples are shown in Table 1.

PREPARATION EXAMPLE 1

Preparation of Graft Polymer

In an autoclave reactor equipped with a thermometer and a stirrer were placed and sufficiently dissolved 450 parts of xylene and 150 parts of a low-molecular-weight polyethylene Sanwax LEL 400 (trade name, available from Sanyo Chemical Industries, Ltd.; softening point: 128° C.) as a wax. After replacing the inner atmosphere with nitrogen gas, a mixture of 594 parts of styrene, 255 parts of methyl methacrylate, 34.3 parts of di t butyl peroxyhexahydroterephthalate and 120 parts of xylene was added dropwise at 155° C. over 2 hours for polymerization, and the reaction mixture was held at 155° C. for further 1 hour. The solvent was then removed, to yield Graft Polymer W-1 having a number average molecular weight of 3,300, a weight average molecular weight of 12,000, a glass transition temperature Tg of 65.2° C., and a solubility parameter SP of a vinyl resin of 10.4 $(cal/cm^3)^{1/2}$.

PREPARATION EXAMPLE 2

Preparation of Graft Polymer

In an autoclave reactor equipped with a thermometer and a stirrer were placed and sufficiently dissolved 400 parts of xylene and 150 parts of a low-molecular-weight polypropylene Viscol 440P (trade name, available from Sanyo Chemical Industries, Ltd.; softening point: 153° C.). After replacing the inner atmosphere with nitrogen gas, a mixture of 665 parts of styrene, 185 parts of butyl acrylate, 8.5 parts of di t butyl peroxyhexahydroterephthalate and 120 parts of xylene was added dropwise at 160° C. over 2 hours for polymerization, and the reaction mixture was held at 150° C. for further 1 hour. The solvent was then removed, to yield Graft Polymer W-2 having a number average molecular weight of 8,300, a weight average molecular weight of 22,900, a glass transition temperature Tg of 60.5° C., and a solubility parameter SP of a vinyl resin of 10.4 $(cal/cm^3)^{1/2}$.

PREPARATION EXAMPLE 3

Preparation of Graft Polymer

In an autoclave reactor equipped with a thermometer and a stirrer were placed and sufficiently dissolved 450 parts of xylene and 200 parts of a low-molecular-weight polypropylene Viscol 440P (trade name, available from Sanyo Chemical Industries, Ltd.; softening point: 153° C.). After replacing the inner atmosphere with nitrogen gas, a mixture of 200 parts of styrene, 600 parts of methyl methacrylate, 32.3 parts of di t butyl peroxyhexahydroterephthalate and 120 parts of xylene was added dropwise at 150° C. over 2 hours for polymerization, and the reaction mixture was held at 160° C. for further 1 hour. The solvent was then removed, to yield Graft Polymer W-3 having a number average molecular weight of 3,200, a weight average molecular weight of 17,000, a glass transition temperature Tg of 55.3° C., and a solubility parameter SP of a vinyl resin of 10.1 $(cal/cm^3)^{1/2}$.

PREPARATION EXAMPLE 4

Preparation of Graft Polymer

In an autoclave reactor equipped with a thermometer and a stirrer were placed and sufficiently dissolved 480 parts of xylene and 100 parts of a low-molecular-weight polypropylene Viscol 151P (trade name, available from Sanyo Chemical Industries, Ltd.; softening point: 108° C.). After replacing the inner atmosphere with nitrogen gas, a mixture of 755 parts of styrene, 100 parts of acrylonitrile, 45 parts of butyl acrylate, 21 parts of acrylic acid, 36 parts of di t butyl peroxyhexahydroterephthalate and 100 parts of xylene was added dropwise at 170° C. over 3 hours for polymerization, and the reaction mixture was held at 170° C. for further 0.5 hour. The solvent was then removed, to yield Graft Polymer W-4 having a number average molecular weight of 3,300, a weight average molecular weight of 18,000, a glass transition temperature Tg of 65.0° C., and a solubility parameter SP of a vinyl resin of 11.0 $(cal/cm^3)^{1/2}$.

PREPARATION EXAMPLE 5

Preparation of Vinyl Resin

In an autoclave reactor equipped with a thermometer and a stirrer was placed 450 parts of xylene. After replacing the inner atmosphere with nitrogen gas, a mixture of 700 parts of styrene, 300 parts of methyl methacrylate, 34.3 parts of di t butyl peroxyhexahydroterephthalate and 120 parts of xylene was added dropwise at 155° C. over 2 hours for polymerization, and the reaction mixture was held at 155° C. for further 1 hour. The solvent was then removed, to yield a vinyl resin B-1 having a number average molecular weight of 3,500, a weight average molecular weight of 9,100, and a glass transition temperature Tg of 68.8° C.

PREPARATION EXAMPLE 6

Preparation of Fine Polymer Particles as Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS 30 (trade name, available from Sanyo Chemical Industries, Ltd.), 73 parts of styrene, 83 parts of methacrylic acid, 130 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Polymer Particle Dispersion 1] of a vinyl resin (a copolymer of styrene methacrylic acid butyl acrylate sodium salt of sulfuric acid ester of ethylene oxide adduct of methacrylic acid). Fine Polymer Particle Dispersion 1 had a volume average particle diameter of 80 nm as determined with a laser diffraction scattering size distribution analyzer LA 920 (trade name, available from Horiba, Ltd.). Part of Fine Polymer Particle Dispersion 1 was dried to isolate a resin component. The resin component had a Tg of 59° C. and a weight average molecular weight of $15\times10^4$.

PREPARATION EXAMPLE 7

Preparation of Aqueous Phase

Aqueous Phase 1 was prepared as an opaque white liquid by blending and stirring 990 parts of water, 83 parts of Fine Polymer Particle Dispersion 1, 37 parts of a 48.5% aqueous solution of sodium dodecyl diphenyl ether disulfonate ELEMINOL MON 7 (trade name, available from Sanyo Chemical Industries, Ltd.), and 90 parts of ethyl acetate.

PREPARATION EXAMPLE 8

Preparation of Unmodified Polyester

In a reactor equipped with a condenser, a stirrer and a nitrogen gas feed tube were placed 770 parts of an ethylene oxide (2 mole) adduct of bisphenol A and 220 parts of terephthalic acid. The mixture was polycondensed at 210° C. at normal atmospheric pressure for 10 hours and was further reacted at a reduced pressure of 10 to 15 mmHg for 5 hours. After cooling to 160° C., the reaction mixture was further treated with 18 parts of phthalic anhydride for 2 hour and thereby yielded an Unmodified Polyester 1 (PE 1).

Unmodified Polyester 1 (PE 1) had a Tg of 47° C., a weight average molecular weight Mw of 28,000, a peak molecular weight of 3,500, and an acid value of 15.3.

PREPARATION EXAMPLE 9

Preparation of Prepolymer

In a reactor equipped with a condenser, a stirrer and a nitrogen gas feed tube were placed 660 parts of ethylene oxide (2 mole) adduct of bisphenol A, 274 parts of isophthalic acid, 15 parts of trimellitic anhydride and 2 parts of dibutyltin oxide. The mixture was reacted at 230° C. at normal atmospheric pressure for 8 hours, was further reacted under a reduced pressure of 10 to 15 mmHg for 5 hours while dehydrating. After cooling to 160° C., the reaction mixture was treated with 32 parts of phthalic acid anhydride for 2 hours. After cooling to 80° C., the reaction mixture was further treated with 155 parts of isophorone diisocyanate in ethyl acetate for 2 hours, to yield Isocyanate-containing Prepolymer.

PREPARATION EXAMPLE 10

Preparation of Ketimine Compound

In a reactor equipped with a stirring rod and a thermometer were placed 30 parts of isophoronediamine and 70 parts of methyl ethyl ketone, followed by reaction at 50° C. for 5 hours to yield Ketimine Compound 1.

PREPARATION EXAMPLE 11

Preparation of Master Batch

A total of 1,200 parts of water, 540 parts of carbon black Printex 35 (trade name, available from Degussa AG; DBP oil absorbance: 42 ml/100 mg; pH: 9.5), and 1,200 parts of a polyester resin was mixed in a pressure kneader, was kneaded at 150° C. for 30 minutes in a two roll mill, was cold rolled, was pulverized in a pulverizer and thereby yielded Master Batch 1.

PREPARATION EXAMPLE 12

Preparation of Oil Phase

In a reactor equipped with a stirring rod and a thermometer were placed 378 parts of Unmodified Polyester 1, 110 parts of carnauba wax, 22 parts of a salicylic acid metal complex Bontron E 84 (trade name, available from Orient Chemical Industries, Ltd.) as a charge control agent (CCA), 22 parts of Graft Polymer W-1 and 947 parts of ethyl acetate. The mixture was heated and then held at 80° C. for 5 hours with stirring and was then cooled to 30° C. over 1 hour. The mixture was further treated with 500 parts of Master Batch 1 and 500 parts of ethyl acetate with stirring for 1 hour and thereby yielded Material Solution 1.

Next, 1,324 parts of Material Solution 1 was placed in a vessel, and the carbon black and wax components therein were dispersed using a bead mill (ULTRAVISCO MILL available from Aimex Co., Ltd.) at a liquid feeding speed of 1 kg/hr, a disc peripheral speed of 6 m/sec., using zirconia beads 0.5 mm in diameter filled 80% by volume. The dispersing procedure was repeated a total of three times to disperse the carbon black and wax. The dispersion was further mixed with 1,324 parts of a 65% ethyl acetate solution of Unmodified Polyester 1, and the mixture was dispersed under the above conditions, except that the dispersion procedure was performed once, to yield Pigment wax Dispersion 1. Pigment wax Dispersion 1 had a solid content of 50% as determined by heating the dispersion at 130° C. for 30 minutes.

EXAMPLE 1

Preparation of Toner Emulsification to Solvent Removal

In a vessel were placed 749 parts of Pigment wax Dispersion 1, 115 parts of Prepolymer 1, and 2.9 parts of Ketimine Compound 1, and the mixture was mixed at 5,000 rpm for 1 minute by a T.K. HOMO MIXER (trade name, available from Tokushu Kika Kogyo Co., Ltd.). Next, the mixture was treated with 1,200 parts of Aqueous Phase 1 by dispersing at 13,000 rpm for 20 minutes by a T.K. HOMO MIXER and thereby yielded Emulsified Slurry 1.

In a vessel equipped with a stirrer and a thermometer was placed Emulsified Slurry 1 and was heated at 30° C. for 8 hours to remove the solvents therefrom. The slurry was aged at 45° C. for 4 hours and thereby yielded Dispersed Slurry 1.

Washing to Drying

A total of 100 parts of Dispersed Slurry 1 was filtered under a reduced pressure and was washed by the following procedures.

(1) The filtered cake and 100 parts of deionized water were mixed in a T.K. HOMO MIXER at 12,000 rpm for 10 minutes, and the mixture was filtered.

(2) The filtered cake prepared in (1) and 100 parts of a 10% aqueous solution of sodium hydroxide were mixed in a T.K. HOMO MIXER at 12,000 rpm for 30 minutes, and the mixture was filtered under a reduced pressure.

(3) The filtered cake prepared in (2) and 100 parts of a 10% hydrochloric acid were mixed in a T.K. HOMO MIXER at 12,000 rpm for 10 minutes, and the mixture was filtered.

(4) The filtered cake prepared in (3) and 300 parts of ion exchanged water were mixed in a T.K. HOMO MIXER at 12,000 rpm for 10 minutes, and the mixture was filtered, wherein this washing procedure was further repeated twice to yield Filtered Cake 1.

Filtered Cake 1 was dried at 45° C. for 48 hours in a circulating air dryer, was sieved through a 75 μm mesh sieve and thereby yielded Base Toner Particles 1.

Next, 100 parts of Base Toner Particles 1 and 0.25 part of a charge control agent Bontron E 84 (trade name, available from Orient Chemical Industries, Ltd., Japan) were mixed in a Q Mixer (trade name, available from Mitsui Mining Co., Ltd.) at a peripheral speed of a turbine blade of 50 m/sec. The mixing was performed for 2 minutes and stopped for 1 minute, and this cycle was repeated a total of five times. The total treating time was 10 minutes.

The resulting article was further stirred with 0.5 part of a hydrophobic silica HDK H2000 (trade name, available from Clariant Japan Co., Ltd.) at a peripheral speed of 15 m/sec.

The stirring was performed for 30 seconds and stopped for 1 minute, and this cycle was repeated five times to yield Toner 1 (black toner).

EXAMPLE 2

Toner 2 was prepared by the procedure of Example 1, except using Graft Polymer W-4 was used instead of Graft Polymer W-1 in Material Solution 1.

COMPARATIVE EXAMPLE 1

Toner 3 was prepared by the procedure of Example 1, except that Graft Polymer W-1 was not used in Material Solution 1.

COMPARATIVE EXAMPLE 2

Toner 4 was prepared by the procedure of Example 1, except that an ungrafted resin as a 15:85 mixture of a polyolefin resin Sanwax LEL 400 (trade name, available from Sanyo Chemical Industries, Ltd.; softening point: 128° C.) and Vinyl Resin B-1 was used instead of Graft Polymer W-1 in Material Solution 1.

EXAMPLE 3

Toner 5 was prepared by the procedure of Example 1, except using Graft Polymer W-2 was used instead of Graft Polymer W-1 in Material Solution 1.

EXAMPLE 4

Toner 6 was prepared by the procedure of Example 1, except using Graft Polymer W-3 was used instead of Graft Polymer W-1 in Material Solution 1.

COMPARATIVE EXAMPLE 3

To 709 g of ion exchanged water was added 451 g of a 0.1 M $Na_2PO_3$ aqueous solution, and the mixture was heated at 60° C. Thereafter, the mixture was dispersed at 12,000 rpm by a T.K. HOMO MIXER (trade name, available from Tokushu Kika Kogyo Co., Ltd.). Next, to the mixture was gradually added 68 g of 1.0M-$CaCl_2$ solution and thereby yielded an aqueous medium containing $CaPO_3$.

In the T.K. HOMO MIXER were added 170 g of styrene, 30 g of 2-ethylhexyl acrylate, 10 g of REGAL 400R (trade name, available from Cabot Co.), 60 g of paraffin wax (softening point: 70° C.), 5 g of di tert butyl salicylic acid metal compound, 5 g of styrene-methacrylic acid copolymer (Molecular Weight: 50,000; Acid Value: 20 mgKOH/g), and the mixture was heated at 60° C., uniformly dissolved and dispersed at 12,000 rpm. To the mixture were further added and dissolved 10 g of 2, 2'-azobis(2,4-dimethyl valeronitrile) served as a polymerization initiator, and thereby yielded monomers.

To the aqueous medium were add the yielded monomers, were mixed at 12,000 rpm for 20 minutes by a T.K. HOMO MIXER under the atmosphere of $N_2$ at 60° C., and thereby granulating the monomers. Next, the granulated monomers were subjected to a reaction for 3 hours at 60° C. while mixing with a paddle-mixing blade. Thereafter, the temperature of the reacting dispersion was raised to 80° C. and the reacting dispersion was subjected to a further reaction for 10 hours. After the completion of polymerization reaction, the solution was cooled, and hydrochloric acid was added so as to dissolve calcium phosphate therein. The solution was filtered, washed and filtered thereby yielded Base Toner Particle 7.

Next, 100 parts of Base Toner Particles 7 and 0.25 part of a charge control agent Bontron E 84 (trade name, available from Orient Chemical Industries, Ltd., Japan) were mixed in a Q Mixer (trade name, available from Mitsui Mining Co., Ltd.) at a peripheral speed of a turbine blade of 50 m/sec. The mixing was performed for 2 minutes and stopped for 1 minute, and this cycle was repeated a total of five times. The total treating time was 10 minutes.

The resulting article was further stirred with 0.5 part of a hydrophobic silica HDK H2000 (trade name, available from Clariant Japan Co., Ltd.) at a peripheral speed of 15 m/sec. The stirring was performed for 30 seconds and stopped for 1 minute, and this cycle was repeated five times to yield Toner 7 (black toner).

PREPARATION EXAMPLE 13

Preparation of Carrier

| | |
|---|---|
| Silicone resin (organo straight silicone) | 100 parts |
| Toluene | 100 parts |
| γ (2 aminoethyl)aminopropyltrimethoxysilane | 5 parts |
| Carbon black | 10 parts |

The above components were mixed and dispersed in a homo mixer for 20 minutes and thereby yielded a coating composition. The coating composition was applied to 1,000 parts of spherical magnetite having an average particle diameter of 50 μm using a fluidized bed coater to yield Magnetic Carrier 1.

A total of 4 parts of each of Toners 1 to 4 was mixed with 96 parts of Magnetic Carrier 1 and thereby yielded Two component Developers 1 to 4. The properties of Developers 1 to 4 determined by the following methods are shown in Table 1.

Lowest Fixing Temperature

A copying test was carried out on Type 6200 Paper (trade name, available from Ricoh Company Limited) using a copier imagio NEO 450 (trade name, available from Ricoh Company Limited) modified in the following manner. The lowest fixing temperature (° C.) was defined as a temperature of the fixing roller at which a survival rate of the image density was 70% or more after rubbing the fixed image with a pat. The fixing device of the copier was modified to have an iron Fe cylinder 0.34 mm thick as a fixing roller. The contact pressure was set at $1.0\times10^5$ Pa.

Hot Offset Occurring Temperature (HOT)

The image fixing procedure of the above lowest fixing temperature test was performed, and occurrence of hot offset to the fixed image was visually observed. The hot offset occurring temperature (HOT) was defined as a temperature of the fixing roller at which hot offset occurred.

High-Temperature Storage Stability

A sample toner was stored at 50° C. for 8 hours, followed by sieving through a 42 mesh sieve for 2 minutes. The high-temperature storage stability of the sample toner was determined as the ratio of mesh on (residual ratio) according to the following criteria. A toner has a decreasing residual ratio with an increasing storage stability at high-temperatures.

A: The residual ratio is less than 10%.

B: The residual ratio is 10% or more and less than 20%.

C: The residual ratio is 20% or more and less than 30%.

D: The residual ratio is 30% or more.

Image Density, Density Uniformity and Fogging

The above properties were determined in the following manner. Using a sample two component developer, 100,000 copies of a horizontal A4 sized chart (Image Pattern A) were produced using a copier imagio NEO 450 (trade name, available from Ricoh Company Limited) having a cleaning blade and a charger roller in contact with a photoconductor. Image Pattern A contained black solid portions and white solid portions arranged alternatively at intervals of 1 cm in a direction perpendicular to the rotation direction of a developing sleeve. Thereafter, a specific image as mentioned below was produced and the reproduced image was evaluated according to the following criteria.

(1) Image Density

One copy of a horizontal A4 sized black solid checkered image 1 cm wide and 1 cm long was reproduced, and image densities at five points at the center and at four corners were determined with an image Macbeth densitometer, and the average of five densities was calculated. The image density was evaluated according to the following criteria.

A: The average image density is 1.4 or more.

B: The average image density is 1.3 or more and less than 1.4.

C: The average image density is 1.2 or more and less than 1.3.

D: The average image density is 1.1 or more and less than 1.2.

E: The average image density is less than 1.1.

(2) Density Uniformity

One copy of A3 sized black and white repeated image (halftone) of 2 dots by 2 dots (600 dpi) was reproduced. The density uniformity was evaluated in five levels according to the following criteria. Image Pattern A was developed on a sleeve in a negative pattern, thus the sleeve has density irregularity when the image has irregular densities, and the resulting reproduced image shows irregular densities especially in such a halftone image.

A: Excellent

B: Good

C: Average

D: Poor

E: Very poor (3) Fogging

The toner density in a non image portion at the begging of production of 100,000 copies and that after the production were compared and evaluated according to the following criteria in five levels.

A: Excellent

B: Good

C: Average

D: Poor

E: Very poor

Filming

The above property was determined in the following manner. Using a sample two component developer, copies of a horizontal A4 sized chart (Image Pattern A) were produced at normal atmospheric temperature using a copier imagio NEO 450 (trade name, available from Ricoh Company Limited) having a cleaning blade and a charger roller in contact with a photoconductor. Image Pattern A contained black solid portions and white solid portions arranged alternatively at intervals of 1 cm in a direction perpendicular to the rotation direction of a developing sleeve. The filming on the photoconductor after producing 20,000 copies, 50,000 copies and 100,000 copies was determined based on the occurrence of an irregular image (density irregularity in halftone image) in the following manner.

After exposing at 30° C. at 90% for 2 hour or more, a halftone image of 1 dot by 1 dot was reproduced on an A3 sized sheet, and the reflective image densities (ID) of the thickest portion and the thinnest portion of the halftone were determined with a Macbeth densitometer. The difference between the two densities was evaluated according to the following criteria in five levels. If no filming occurs, the two densities are substantially the same. The difference between the two densities increases with an increasing irregularity in halftone image. The possibility of filming increases with an increasing number of copies.

A: The difference is 0.05 or less.

B: The difference is from 0.06 to 0.1.

C: The difference is from 0.11 to 0.25.

D: The difference is from 0.26 to 0.4.

E: The difference is 0.41 or more.

TABLE 1

| | Toner | Developer | Lowest fixing temperature | Hot | High-temperature storage stability | Image density | Density uniformity | Fogging | Filming 20,000 copies | Filming 50,000 copies | Filming 100,000 copies |
|---|---|---|---|---|---|---|---|---|---|---|---|
| Example 1 | Toner 1 | Developer 1 | 160° C. | 220° C. | B | B | B | B | A | A | B |
| Example 2 | Toner 2 | Developer 2 | 160° C. | 240° C. | A | A | A | A | A | A | A |
| Example 3 | Toner 5 | Developer 5 | 160° C. | 230° C. | B | B | B | B | A | A | B |
| Example 4 | Toner 6 | Developer 6 | 160° C. | 240° C. | B | B | B | B | B | B | B |
| Comp. Ex. 1 | Toner 3 | Developer 3 | 180° C. | 180° C. | E | D | D | D | B | D | E |
| Comp. Ex. 2 | Toner 4 | Developer 4 | 190° C. | 180° C. | D | D | D | D | B | D | E |
| Comp. Ex. 3 | Toner 7 | Developer 7 | 200° C. | 200° C. | D | D | D | D | B | D | E |

As is described in detail above, the present invention can provide a toner which has improved low-temperature image-fixing properties and offset resistance for reducing power consumption, can form a high quality toner image and can be stored stably for a long period of time. The present invention can also provides a high quality toner, which is resistant to filming to, for example, a latent electrostatic image bearing member and is free from fogging over a long period of time. The present invention can further provide a toner which can be fixed in a wide range and can produce high quality images. In addition, a toner which has good gloss when used as a color toner and exhibits excellent hot offset resistance is provided. The present invention can also provide a toner which can produce images with higher resolution and higher precision, and a developer which does not invite image deterioration over a long period of time.

In addition, the present invention can provide an image forming apparatus with a fixing device which has high efficiency and can be turned on in a shorter time. The image forming apparatus can employ an amorphous silicon photoconductor. Such an amorphous silicon photoconductor has high sensitivity with light with long wavelength, such as semiconductor laser light (770 to 800 nm), is resistant to degradation caused by repetitive use and is thereby usable as an electrophotographic photoconductor, for example, in a high speed copier or a laser beam printer (LBP). By configuring the image forming apparatus so as to apply a vibrating bias voltage in which a direct current voltage and an alternating voltage are superimposed, upon development of the latent electrostatic image on the photoconductor, highly precise images without roughness can be obtained. In addition, the present invention can provide an image forming method employing a charger in which ozone formation is reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner for developing latent electrostatic images, produced by a process comprising the steps of:

dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted;

dispersing the solution or dispersion in an aqueous medium during at least one of elongation and crosslinking reactions of the resin reactive with a compound having an active hydrogen group thereby forming a reacted dispersion;

removing the organic solvent after or during at least one of the elongation and crosslinking reactions of the resin reactive with a compound having an active hydrogen group; and washing and drying particles formed by removing the organic solvent.

2. A toner for developing latent electrostatic images according to claim 1, wherein the composition further comprises a coloring agent.

3. A toner for developing latent electrostatic images according to claim 1, wherein the composition further comprises a compound having an active hydrogen group.

4. A toner for developing latent electrostatic images according to claim 1, wherein the process further comprises the step of adding a compound having an active hydrogen group during the step of dispersing the solution or dispersion in the aqueous medium.

5. A toner for developing latent electrostatic images according to claim 1, wherein the polyolefin resin A has a softening point of from 80° C. to 140° C.

6. A toner for developing latent electrostatic images according to claim 1, wherein the polyolefin resin A comprises at least one monomer unit selected from the group consisting of ethylene, propylene, 1-butene, isobutylene, 1-hexene, 1-dodecene and 1-octadecene.

7. A toner for developing latent electrostatic images according to claim 1, wherein the polyolefin resin A has a number average molecular weight of from 500 to 20,000 and a weight average molecular weight of from 800 to 100,000.

8. A toner for developing latent electrostatic images according to claim 1, wherein the vinyl resin B has a solubility parameter SP of from 10.0 to 12.6.

9. A toner for developing latent electrostatic images according to claim 1, wherein the amount of the graft polymer C is from 10 to 500 parts by weight relative to 100 parts by weight of the releasing agent.

10. A toner for developing latent electrostatic images according to claim 1, wherein the vinyl resin B comprises one of:

styrene;

a combination of styrene and an alkyl ester of acrylic acid;

a combination of styrene and an alkyl ester of methacrylic acid;

a combination of styrene and acrylonitorile;

a combination of styrene and methacrylonitorile;

a combination of styrene, an alkyl ester of acrylic acid and acrylonitorile;

a combination of styrene, an alkyl ester of acrylic acid and methacrylonitorile;

a combination of styrene, an alkyl ester of methacrylic acid and acrylonitorile; and a combination of styrene, an alkyl ester of methacrylic acid and methacrylonitorile.

11. A toner for developing latent electrostatic images according to claim 1, wherein the releasing agent comprises at least one selected from the group consisting of a carnauba wax free of nonesterified fatty acid, a rice wax, a montan wax and an ester wax.

12. A toner for developing latent electrostatic images according to claim 1, wherein the toner particles have an elliptic shape.

13. A toner for developing latent electrostatic images according to claim 1, wherein the toner particles have an elliptic shape having a major axis r1, a minor axis r2 and a thickness r3, wherein the ratio (r2/r1) of the minor axis r2 to the major axis r1 is from 0.5 to 0.8, and the ratio (r3/r2) of the thickness r3 to the minor axis r2 is from 0.7 to 1.0.

14. A toner for developing latent electrostatic images according to claim 1, wherein the resin reactive with a compound having an active hydrogen group, comprises a polyester prepolymer having an isocyanate group, and the compound having an active hydrogen group comprises one of an amine and a derivative thereof.

15. A toner for developing latent electrostatic images according to claim 1, wherein the aqueous medium comprises at least one of inorganic dispersing agents and fine polymer particles.

16. A two-component developer for developing latent electrostatic images, comprising a carrier and a toner, wherein the toner is produced by a process comprising the steps of:

dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted;

dispersing the solution or dispersion in an aqueous medium during at least one of elongation and crosslinking reactions of the resin reactive with a compound having an active hydrogen group thereby forming a reacted dispersion;

removing the organic solvent after or during at least one of the elongation and crosslinking reactions of the resin reactive with a compound having an active hydrogen group; and washing and drying particles formed by removing the organic solvent.

17. An image forming apparatus comprising:

a photoconductor;

a charger for charging the photoconductor;

an exposer for exposing the photoconductor to light to form a latent electrostatic image;

a developing unit containing a toner and serving for developing the latent electrostatic image using the toner to form a toner image;

a transferring unit for transferring the toner image from the photoconductor to a transfer material; and an image fixing unit comprising two rollers for allowing the toner image on the transfer material to pass through between the two rollers to heat and fuse the toner to thereby fix the toner image, wherein the image forming apparatus is so configured as to perform the image fixing at a contact pressure (roller load divided by contact area) between the two rollers of $1.5\times10^5$ Pa or less, and wherein the toner is produced by a process comprising the steps of:

dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted;

dispersing the solution or dispersion in an aqueous medium during at least one of elongation and crosslinking reactions of the resin reactive with a compound having an active hydrogen group thereby forming a reacted dispersion;

removing the organic solvent after or during at least one of the elongation and crosslinking reactions of the resin reactive with a compound having an active hydrogen group; and washing and drying particles formed by removing the organic solvent.

18. An image forming apparatus according to claim 17, wherein the image fixing unit comprises:

a heater having a heating element;

a film in contact with the heater; and a pressurizing member in intimate contact with the heater with the interposition of the film, wherein the image fixing means is so configured as to allow a recording medium bearing an unfixed toner image to pass through between the film and the pressurizing member to heat and fuse the toner to thereby fix the toner image.

19. An image forming apparatus according to claim 17, wherein the photoconductor is an amorphous silicon photoconductor.

20. An image forming apparatus according to claim 17, wherein the developing unit has an alternating electric field applying unit for applying an alternating electric field upon development of the latent electrostatic image on the photoconductor.

21. An image forming apparatus according to claim 17, wherein the charger comprises a charging member and the charger is so configured as to bring the charging member into contact with the photoconductor and apply a voltage to the charging member to thereby charge the photoconductor.

22. A process cartridge, integrally comprising:

a photoconductor; and at least one means selected from the group consisting of:

a charger for charging the photoconductor;

a developing unit containing a toner and serving for developing a latent electrostatic image using the toner to form a toner image; and a cleaner for cleaning a residual toner on the photoconductor with a blade after transfer, the process cartridge being detachable from and attachable to a main body of an image forming apparatus, wherein the toner produced by a process comprising the steps of:

dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted;

dispersing the solution or dispersion in an aqueous medium during at least one of elongation and crosslinking reactions of the resin reactive with a compound having an active hydrogen group thereby forming a reacted dispersion;

removing the organic solvent after or during at least one of the elongation and crosslinking reactions of the resin reactive with a compound having an active hydrogen group; and washing and drying particles formed by removing the organic solvent.

23. An image forming process, comprising the steps of:

charging a photoconductor;

exposing the photoconductor to light to form a latent electrostatic image;

developing the latent electrostatic image using a toner to form a toner image;

transferring the toner image from the photoconductor to a transfer material; and cleaning a residual toner on the photoconductor with a blade after the transferring step, wherein the toner produced by a process comprising the steps of:

dissolving or dispersing each component of a composition in an organic solvent to form a solution or dispersion, the composition comprising a resin reactive with a compound having an active hydrogen group, a releasing agent, and a graft polymer C of a polyolefin resin A on which a vinyl resin B has been at least partially grafted;

dispersing the solution or dispersion in an aqueous medium during at least one of elongation and crosslinking reactions of the resin reactive with a compound having an active hydrogen group thereby forming a reacted dispersion;

removing the organic solvent after or during at least one of the elongation and crosslinking reactions of the resin reactive with a compound having an active hydrogen group; and washing and drying particles formed by removing the organic solvent.

* * * * *